US006542438B2

(12) United States Patent
Higuchi et al.

(10) Patent No.: US 6,542,438 B2
(45) **Date of Patent: *Apr. 1, 2003**

(54) ELECTRONIC WATCH TRANSMITTING/ RECEIVING SYSTEM

(75) Inventors: Haruhiko Higuchi, Tokyo (JP); Akiyoshi Murakami, Tokyo (JP)

(73) Assignee: Citizen Watch Co., Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/230,931

(22) PCT Filed: Jun. 5, 1998

(86) PCT No.: PCT/JP98/02495

§ 371 (c)(1),
(2), (4) Date: Feb. 3, 1999

(87) PCT Pub. No.: WO98/55902

PCT Pub. Date: Dec. 10, 1998

(65) Prior Publication Data

US 2001/0043511 A1 Nov. 22, 2001

(30) Foreign Application Priority Data

Jun. 5, 1997 (JP) ..... 9-147611

Sep. 3, 1997 (JP) ..... 9-237906

(51) Int. Cl.[7] ..... G04C 3/00; G04C 3/14; G04C 9/02; G04G 1/00; G04G 3/02

(52) U.S. Cl. ..... 368/47; 368/185; 368/187; 368/10

(58) Field of Search ..... 368/10, 47, 185, 368/187

(56) References Cited

FOREIGN PATENT DOCUMENTS

WO 94/16366 * 7/1994

* cited by examiner

*Primary Examiner*—Vit Miska
*Assistant Examiner*—Jeanne-Marguerite Goodwin
(74) *Attorney, Agent, or Firm*—Greer, Burns & Crain, Ltd.

(57) ABSTRACT

A data transmitting/receiving system is configured so as to send data to an analog-type watch, without the need to make direct electrical contact thereto and without influencing the drive of the hands of the watch. When a timing signal that is sent from the watch is received, a data transmitting unit performs transmission. The watch does not receive data at other times, and this receiving operation is performed intermittently.

34 Claims, 24 Drawing Sheets

ELECTRONIC WATCH TRANSMITTING/ RECEIVING SYSTEM

BACKGROUND OF THE INVENTION

1. Field of the Invention

The present invention relates to an electronic watch that performs two-way data communication with an external device.

2. Background of the Invention

As multi-function watches have progressed in recent years, there have appeared many systems in which an IC within a watch has a variety of data. For example, there is the case in a watch having a sensor, in which setting data is provided for the purpose of adjusting the sensor sensitivity and offset at the time of manufacture, and the case in which, when a watch is actually used, various measurement data obtained by sensor operation are stored within the watch beforehand, measurement data being displayed in response to the needs of the user.

Even in a watch without such added functions as sensing, frequency adjustment of the internal reference signal source of the watch is almost always required when the watch is completed.

In a watch having a system in which setting data when frequency adjustment is done is held in a memory inside an IC, frequency adjustment is performed either in the condition of a circuit board onto which are mounted an IC and a quartz crystal, or as a movement, in which case data is often set into the IC by using a writing system that is electrically connected to the circuit board.

In order to achieve a more accurate frequency adjustment, a problem arises with the above-noted method.

Specifically, in the case in which a circuit board or movement is built into a watch case, the oscillation frequency of the reference signal source can shift because of floating capacitance and the like, and the stress applied to the quartz crystal upon mounting into the case can also cause a change in the frequency.

In the above-noted cases, the ideal approach is to adjust the frequency after mounting the movement into the watch case and completely closing the rear cover.

However, the provision of an electrical contact after mounting the movement into the case sacrifices watertight integrity, reduces noise immunity, and presents various restrictions on design.

Therefore, in order to perform writing of frequency adjustment data into the IC after mounting into the case, it becomes necessary to perform contactless transfer of data to an IC on the circuit board.

In a watch that includes a sensor, even in the case in which measurement data is to be transferred to an internal device, this is usually performed using a system with connection contacts, although this is accompanied by a variety of adverse effects, as noted above.

With respect to these problems, a method disclosed in WO 94/16366 is one in which the motor coil of an analog watch is used to perform data transfer electromagnetically between the watch and an external device, data transfer being performed in accordance with a timing signal from the watch, so that data transfer from outside the watch is possible without disturbance to the drive of the watch hands.

It is possible using the method of the past to input data and the like to a watch from outside the watch without at all affecting the normal drive of the watch hands.

However, in the case in which data is input to a watch from outside during the interval between step movement of the watch hands by applying a magnetic field, if an excessively strong magnetic field is applied, not only is the hand drive greatly affected, but also there are cases in which the externally applied magnetic field can even cause the hand drive motor to rotate.

In the case in which the watch circuitry in an analog watch is configured with high sensitivity so as to enable reception of external data and the like even in a weak external magnetic field, it can be envisioned that external magnetic noise can cause faulty operation in the watch when it is in normal use.

Accordingly, an object of the present invention is to alleviate the above-noted problems in the prior art by providing a system which performs reliable transmission of the required data, for example, from a prescribed data transmission unit to an electronic watch, and which completely eliminates the influence on the basic functioning of the electronic watch.

DISCLOSURE OF THE INVENTION

In order to achieve the above-noted object, the present invention has the following basic technical constitution.

Specifically, the present invention is a data transmitting/receiving system in an electronic watch which is configured by an electric watch and a data transmitting unit, separate from the watch, which generates a data signal, a coil within the electronic watch being used by a data receiving means of the electronic watch to receive a data signal from the data transmitting means, the above-noted electronic watch having a timing signal generation means, which generates a timing signal, and the above-noted data transmitting means having a timing signal receiving means, which receives a timing signal which is output from the above-noted timing signal generation means, the data transmitting unit transmitting a data signal to the electronic watch in synchronization with the received timing signal, and the data receiving means in the electronic watch receiving the data which is sent from the data transmitting unit only with a timing at a time when the data is sent from the data transmitting unit.

A more specific configuration of a data transmitting/receiving system of an electronic watch according to the present invention is a data transmitting/receiving system in an electronic watch which is formed, for example, by a data transmitting unit, which generates a data signal, and a data receiving means which receives the data signal from the data transmitting unit, using a coil of a motor used to drive the hands of an analog watch, the electronic watch having a timing signal generation means, which generates a timing signal, the data transmitting unit being provided with a timing signal receiving means, which receives the timing signal output from the above-noted motor coil, the data transmitting unit transmitting the data signal in synchronization with the receiving of the timing signal, and the data receiving means performing receiving of data only at the time of transmission of data from the data transmitting unit.

DESCRIPTION OF THE PREFERRED EMBODIMENTS

Preferred embodiments of a data transmitting/receiving system according to the present invention are described below, with references being made to relevant accompanying drawings.

Figure 1:
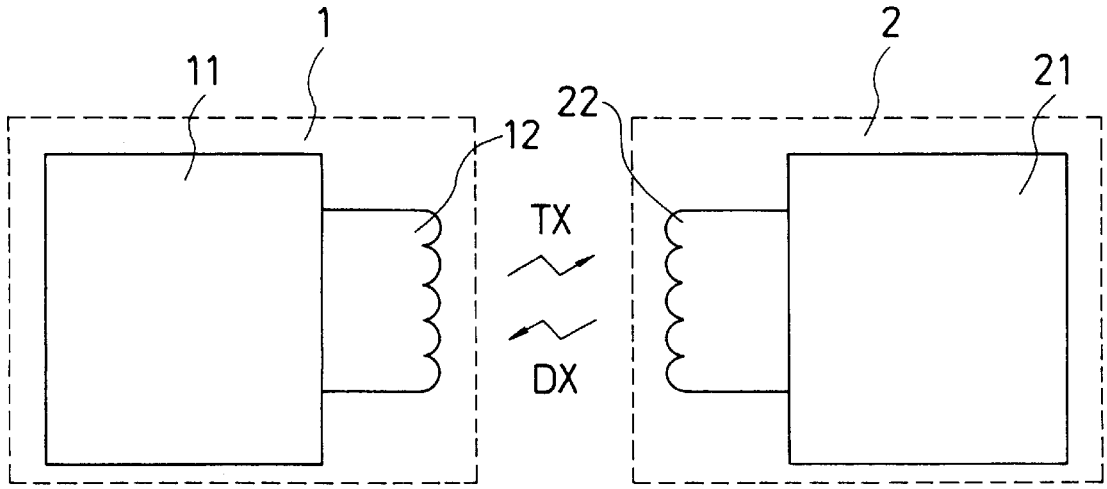
FIG. 1 is a drawing that shows the system configuration of the present invention.
Figure 2:
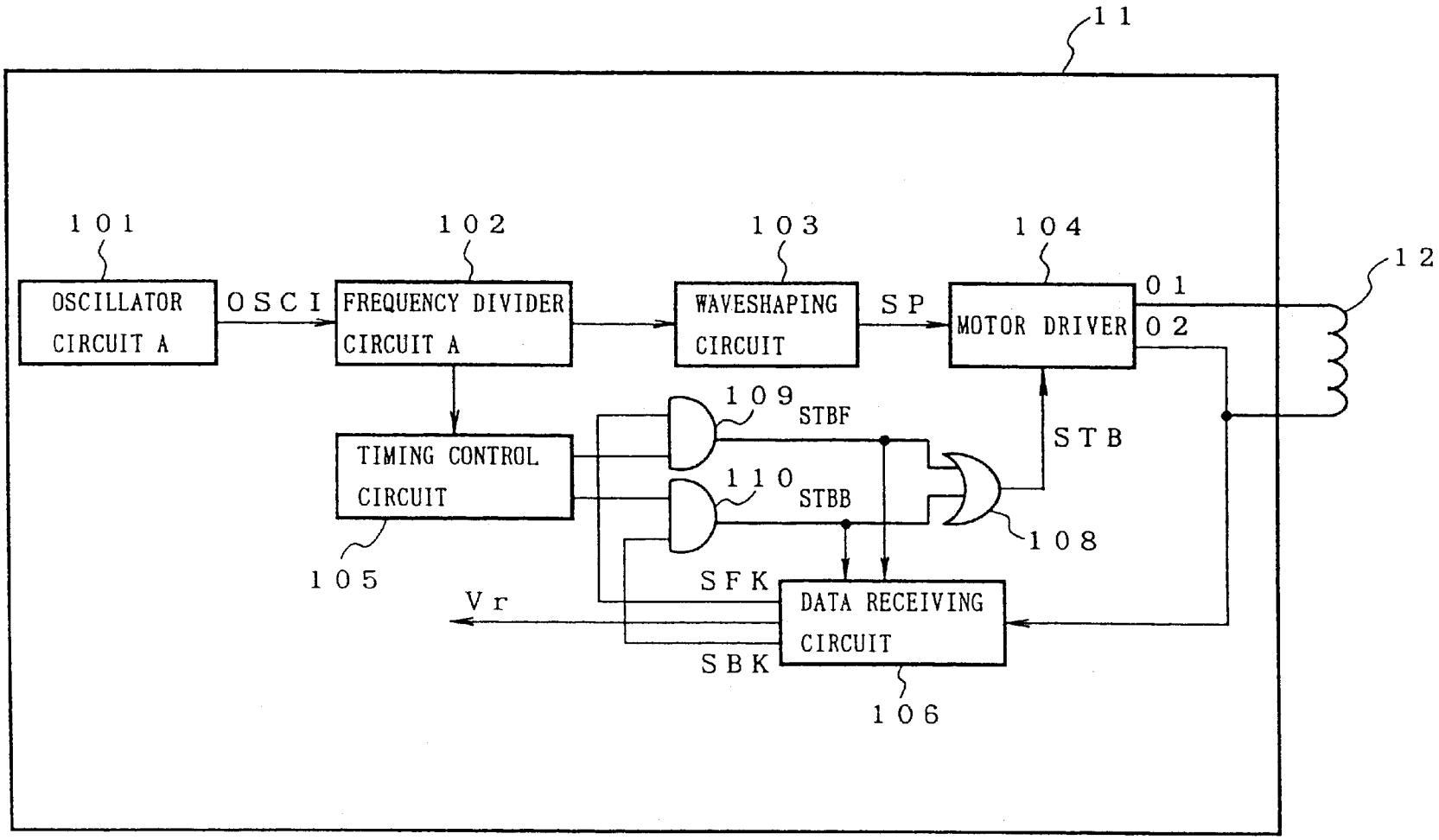
FIG. 2 is a block diagram that shows the circuit configuration of an analog watch according to the present invention.
Figure 3:
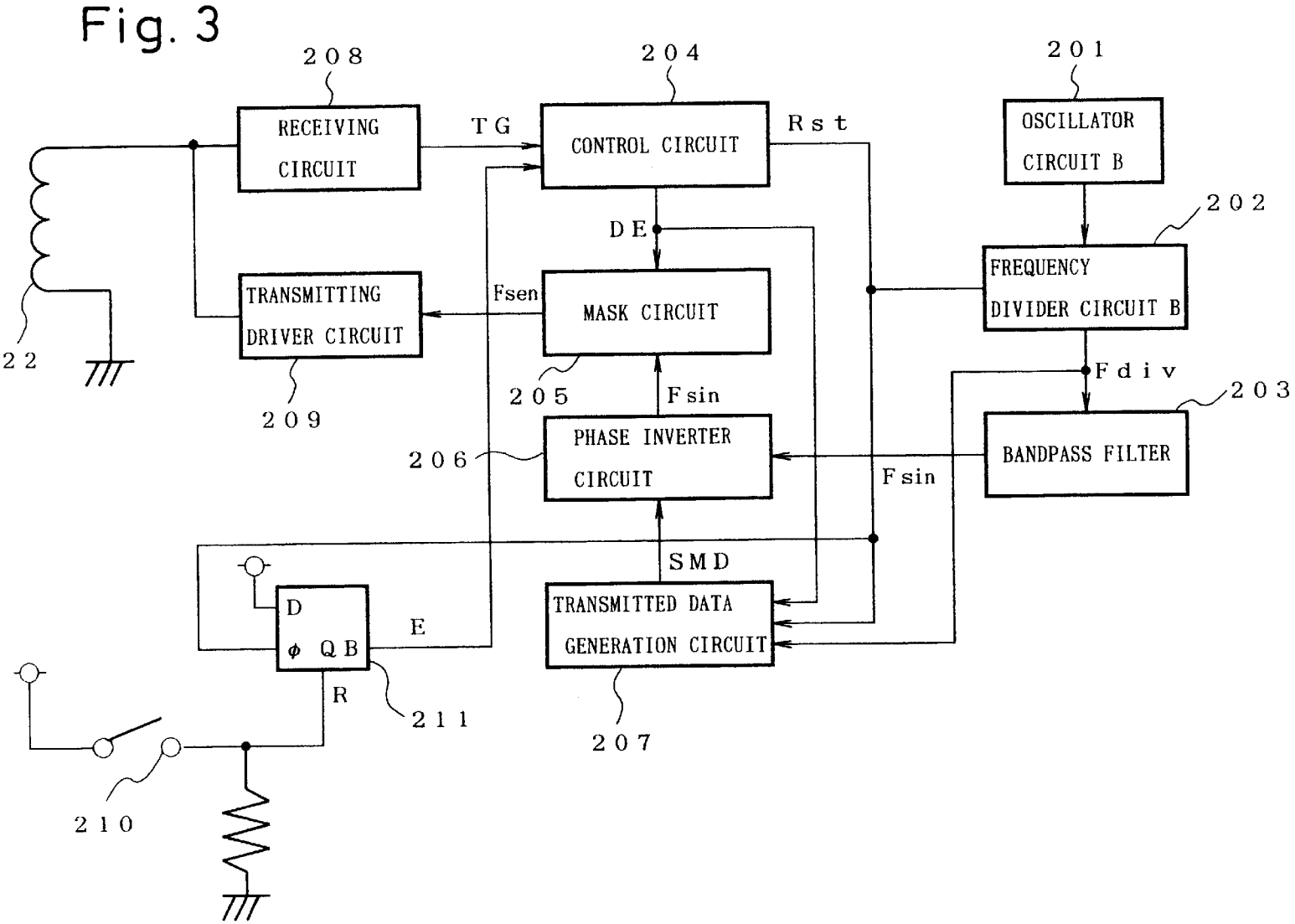
FIG. 3 is a block diagram that shows the circuit configuration of the data transmitting unit of the present invention.

Specifically, FIG. 1 through FIG. 3 illustrate the configuration of a data transmitting/receiving system for an electronic watch according to the present invention. As shown in the above-noted drawings, the present invention is formed by an electronic watch 1 and a data transmitting unit 2, which generates a data signal and which is configured separately from the electronic watch 1.

In a data receiving system provided on an electric watch, in that a data signal output from the above noted data transmitting unit 2, is received by the data receiving means 11 of the watch 1, utilizing a coil 12, that is a part of a receiving means 11, the electronic watch 1 has a timing signal generation means 105, which generates a timing signal, and the above-noted data transmitting unit 2 has a timing signal receiving means 22, which receives the timing signal TX, which is output from the timing signal generation means 105, the data transmitting unit 2 sending data signal DX to the electronic watch 1 in synchronization with the received timing signal TX, the data receiving means 11, which includes the above-noted coil 12 in the electronic watch receiving data that is sent from the data transmitting unit 2 only at the prescribed timing for sending of data from the data transmitting unit 2.

In the present invention, the data receiving means 11, which includes the coil 12, preferably has at least one end of the above-noted coil in a high-impedance condition when receiving data.

In the present invention, it is preferable that the data receiving means 11 be configured so that when it verifies that there is no more data output from the data transmitting unit 2 at a first data receiving timing, it stops the further receiving of data.

Additionally, it is desirable in the present invention that the data receiving operation of the data receiving means 11 be performed intermittently, and further that the period of receiving be established as shorter than the interval between such receiving operations.

In a specific example of the present invention, the data signal DX that is generated from the data transmitting unit 2 can be an amplitude-modulated alternate-current magnetic signal, and this AC magnetic signal can also be phase modulated.

It is desirable that the transmission speed of the data transmission used in the data transmitting/receiving unit of an electronic watch according to the present invention, for example, the frequency of data transmission that is performed intermittently in the data transmitting unit 2, be 1/N times 32,768 Hz, where N is an integer.

Additionally, in a specific example of the present invention, it is desirable that the data receiving means 11 be configured so that, at a first receiving timing, it performs a receiving operation both at a prescribed first phase value of the AC magnetic signal and a prescribed second phase value thereof. More specifically, at the first receiving timing, when data reception is verified at the one of the above-noted phases, at and after a second receiving timing, data receiving is performed at this phase value, but data receiving is not performed at the other phase value.

In a specific example of an electronic watch data transmitting/receiving system according to the present invention, the data receiving means 11 is configured so as to perform a receiving operation when the phase of the AC magnetic field is at a timing of 90 degrees and a timing of 270 degrees at the first receiving timing.

For example, when the data receiving means 11 detects transmitted data from the data transmitting unit 2 when the AC magnetic field phase is 90 degrees at the first receiving timing, it performs an operation of detection only at the timing at which the phase is 90 degrees at and after the second detection timing.

If, however, the data receiving means 11 detects transmitted data from the data transmitting unit 2 when the phase is 270 degrees, it performs an operation of detection only at the timing at which the phase is 270 degrees at an after the second detection timing.

It is desirable that the timing signal in the present invention be output intermittently.

In order to maintain transmission speed maximum, it is preferable in the present invention that, for example, the data transmission frequency of the data signal that is generated by the data transmitting unit 2 be the same as the frequency of the magnetic signal.

Figure 16:
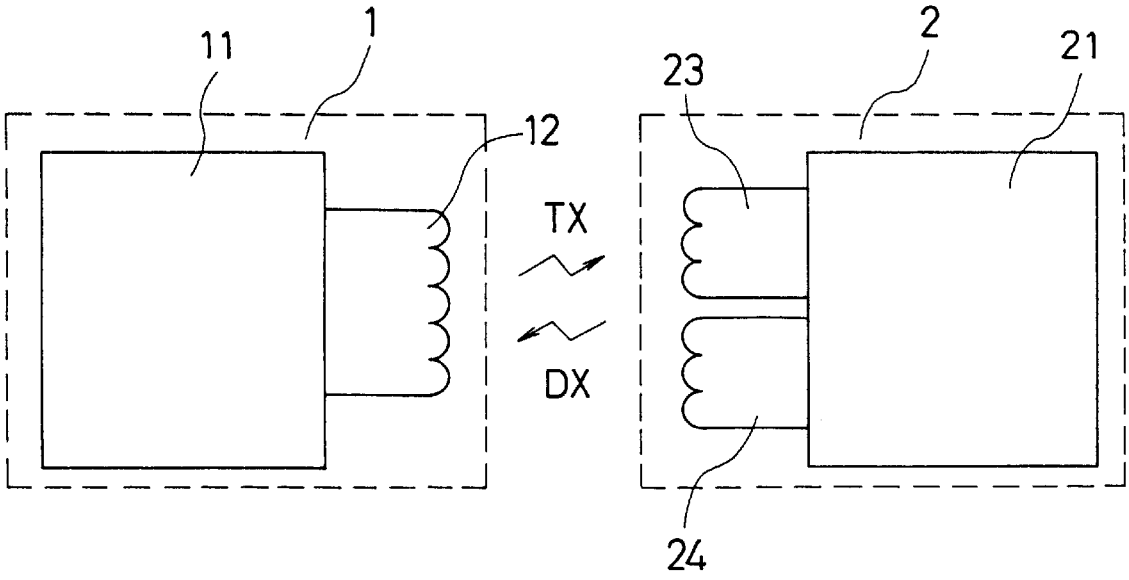
FIG. 16 is a drawing that shows another system configuration of the present invention.

As shown in FIG. 16, in another specific example of a data transmitting/receiving system for an electronic watch according to the present invention, in a data transmitting/receiving system having a data transmitting unit 2, which generates a data signal, and a data receiving means 11, which receives a data signal from the data transmitting unit 2, it is desirable that the electronic watch 1 has a timing signal generation means 105, which generates a timing signal, and that the data transmitting unit 2 has a timing signal receiving means 22, which receives a timing signal TX that is output from the coil 12, the data transmitting unit 2 transmitting the data signal in synchronization with the received timing signal, and it is also desirable that it have a receiving coil 23 for receiving the timing signal and a transmitting coil 24 for transmitting data.

In an electronic watch data transmitting/receiving system according to the present invention, it is desirable that the transmitting coil 24 and the receiving coil 23 be ring-shaped, and that the centers thereof be concentric.

In a specific example of the present invention, it is desirable that the transmitting coil 24 have a reactance that is smaller than that of the receiving coil 23, from the standpoint of accurate data transmission and as a noise countermeasure.

In the same manner, in a data transmitting/receiving system of an electronic watch according to the present invention, it is preferable that the distance at which the data transmission unit 2 can receive the timing signal be short in comparison to the distance at which the data receiving means can receive transmitted data.

Additionally, the data receiving means 11 can be configured so that, when it receives an intermittently generated timing signal at least two times, the data transmission operation is started, and also so that the level of the data signal that is transmitted by the data output means is adjusted in response to the strength of the signal received by the timing signal receiving means.

It is also desirable in the present invention that the transmitting power at the data transmitting unit 2 be larger than the transmitting power at the electronic watch 1.

The configuration of the receiving means 11 can be such that a data transmitting operation is started when the timing signal generated intermittently is received at least two times, and additionally configured so the level of the signal transmitted by the data output means is adjusted in response to the strength of the signal received by the timing signal receiving means.

A specific example of an electronic watch data transmitting/receiving system is described below in detail.

This specific example of an electronic watch transmitting/receiving system according to the present invention as described below is an analog-type electronic watch, the example shown being one in which a hand driving motor is used in the above-noted data transmitting and receiving, although it is obvious from the technical characteristics of the present invention that the present invention is not restricted to this configuration.

Note that, in the separate embodiment of the present invention, the coil may be a coil which forms a part of a beeper circuit used for alarming or the like in the electronic watch, for example.

This embodiment of the present invention is described in detail below.

FIG. 1 is a block diagram that shows the overall configuration of the present invention, in which the reference numeral 1 denotes an analog watch which has an electronic circuit 11 for receiving data and a motor drive coil 12, and 2 denotes a data transmitting unit which has a transmitting/receiving coil 22 and a data transmitting and receiving circuit 21.

While the analog electronic watch 1 normally includes constituent elements such as a driving wheel chain and hands, since these elements are not directly related to this embodiment, they have been omitted from both drawings and the description of the embodiment.

FIG. 2 is a block diagram that shows the circuit configuration of the analog watch 1, and FIG. 3 is a block diagram that shows the detailed circuit configuration of the data transmitting unit 2.

Figure 10:
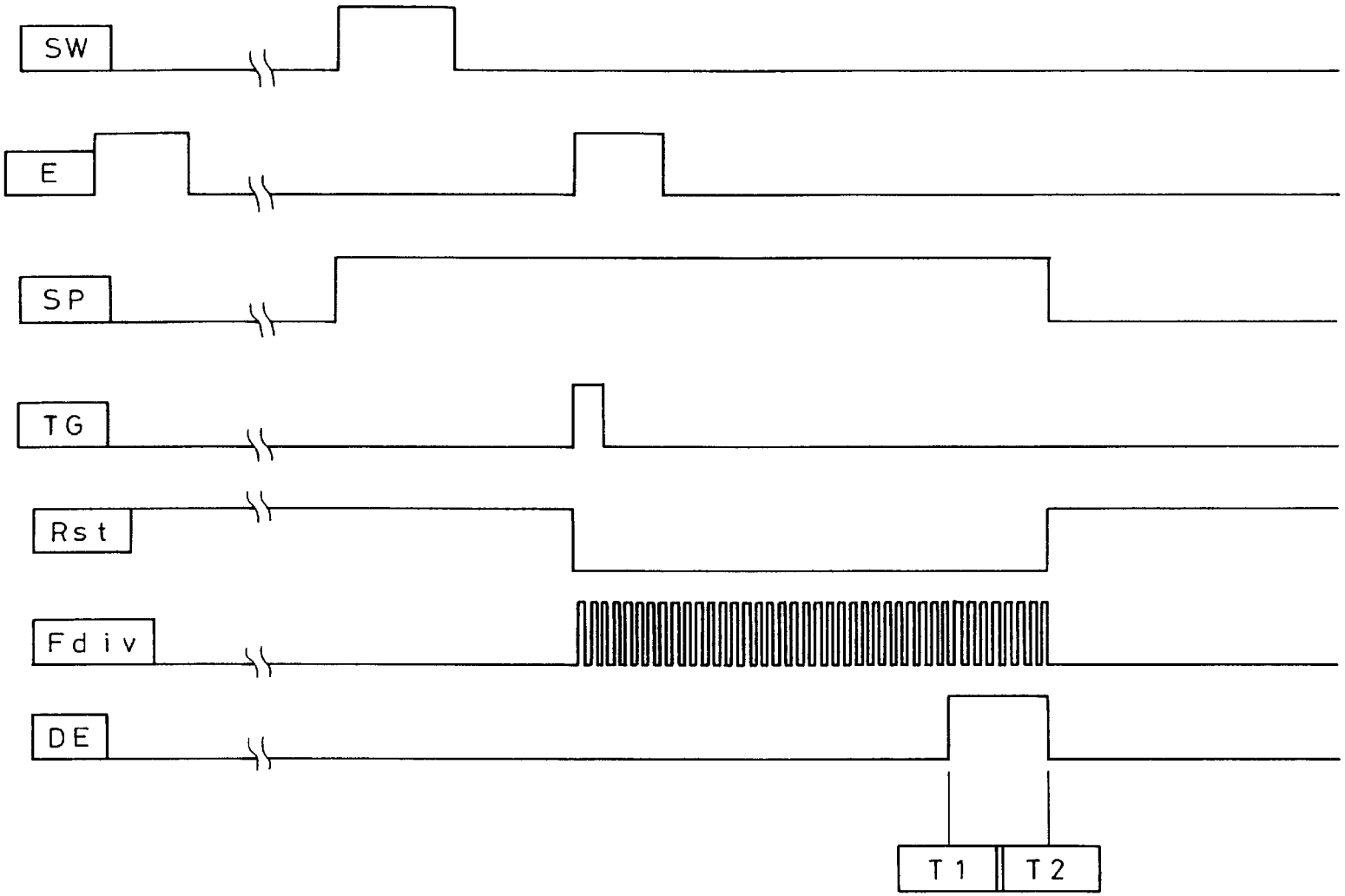
FIG. 10 is a timing diagram that show shows the operation of the present invention.
Figure 11:
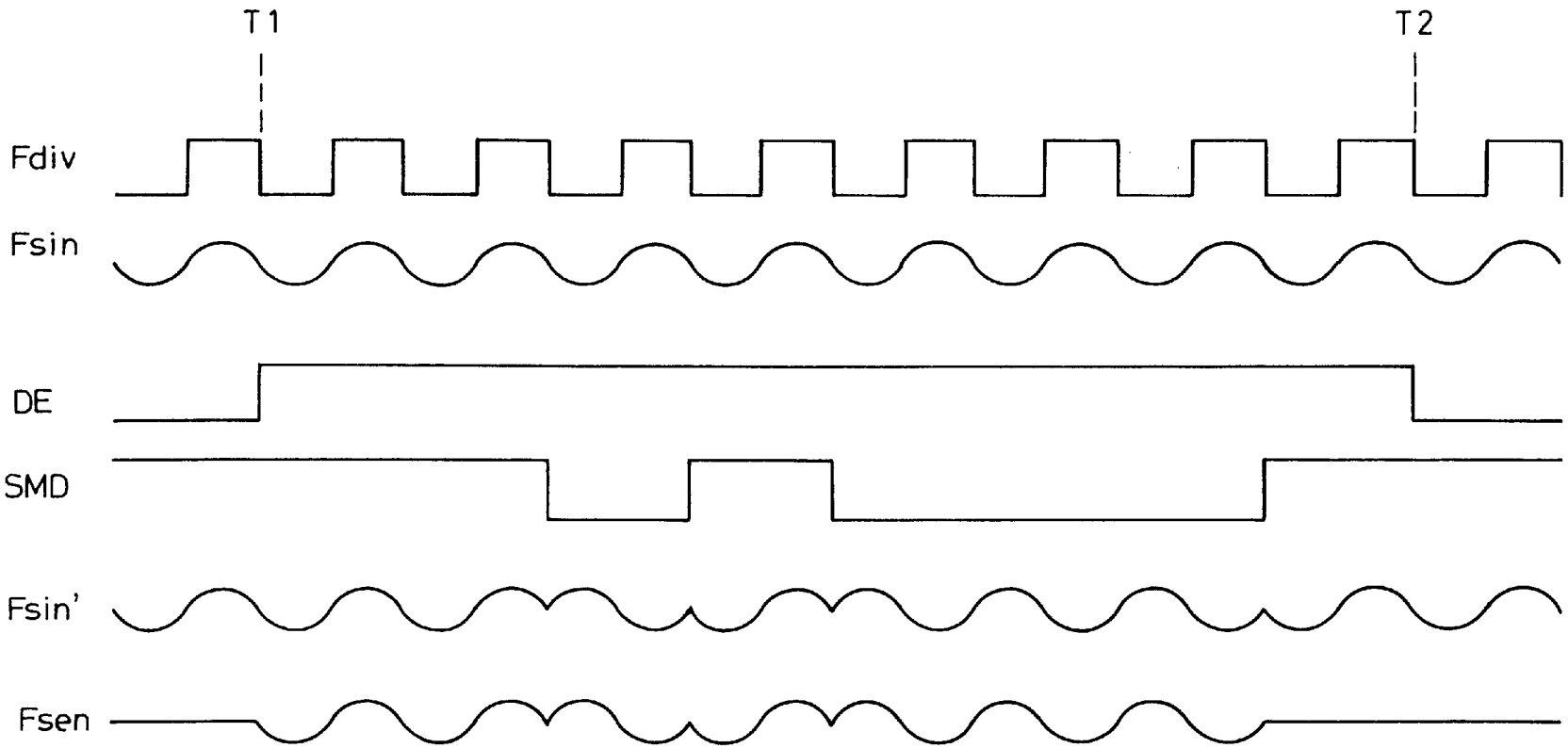
FIG. 11 is a timing diagram that show shows the operation of the present invention.
Figure 12:
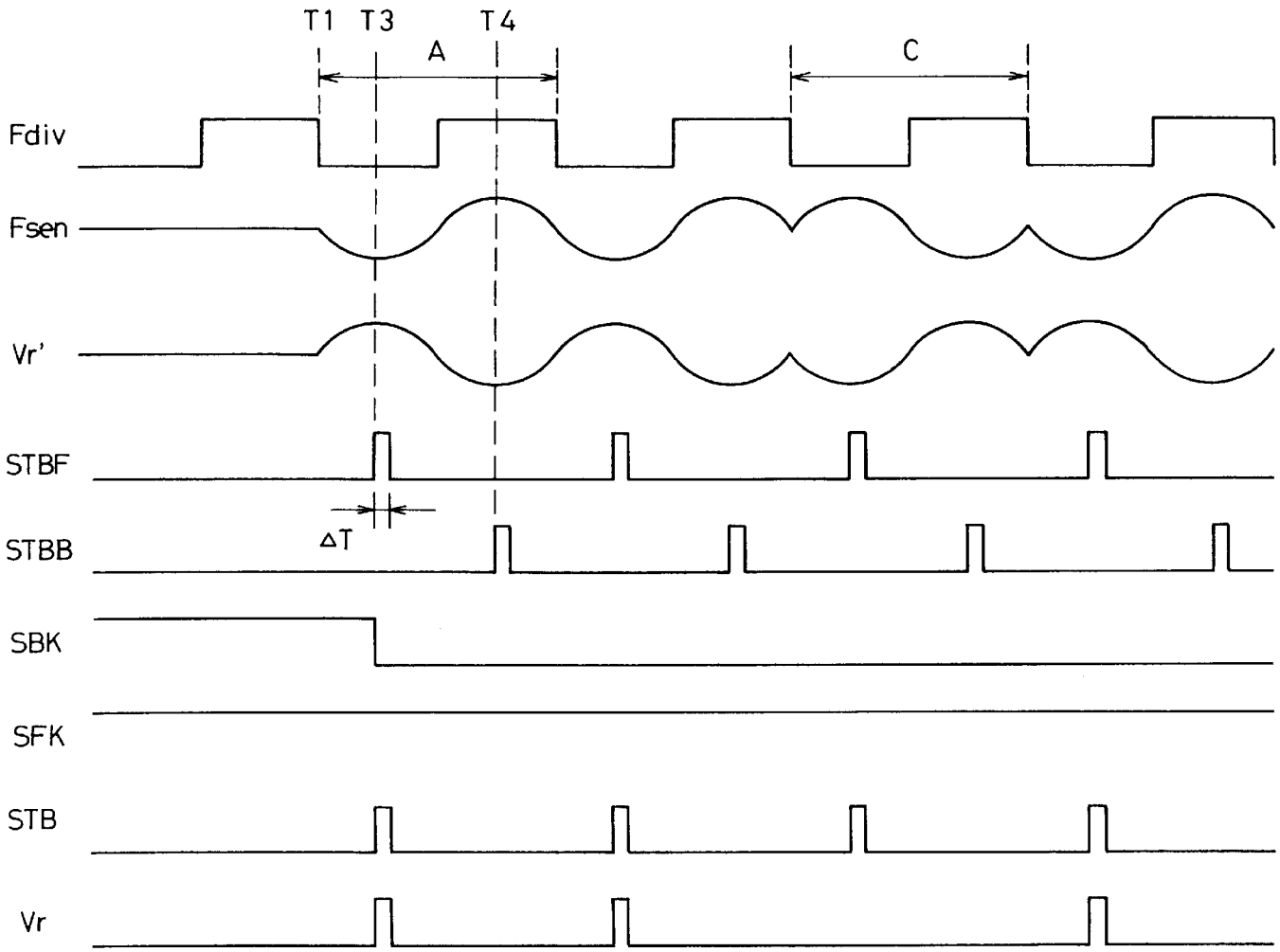
FIG. 12 is a timing diagram that show shows the operation of the present invention.

FIG. 10, FIG. 11, and FIG. 12 are timing diagrams that show the operation of this embodiment of the present invention.

In FIG. 2, the reference numeral 101 denotes an oscillator circuit A, 102 is a frequency divider circuit A, which divides the oscillation signal OSC1 of the above-noted oscillator circuit A so as to obtain the frequencies required in this system, 103 is a wave-shaping circuit, which generates a drive signal (hereinafter referred to as the SP signal) for the purpose of driving a motor of the analog watch 1, 104 is a motor driver for the purpose of outputting the SP signal to the motor drive coil 12, 105 is a timing control circuit, which controls various timing when data is received, 106 is a data receiving circuit, 108 is an OR circuit, and 109 and 110 are AND circuits.

In FIG. 3, the reference number 201 denotes an oscillator circuit B, 202 is a frequency divider circuit B, 203 is a bandpass filter, 204 is a control circuit, 205 is a mask circuit, 206 is a phase inverter circuit, 207 is a transmitted data generation circuit, 208 is a receiving circuit, 209 is a transmitting driver circuit, 210 is a switch, and 211 is a D-type flip-flop.

In the analog watch 1, the drive pulse SP is output at a constant frequency to the motor drive coil 12 for the purpose of driving the watch hands in a normal condition.

This SP signal is obtained as shown in FIG. 2 by the frequency divider circuit A 102, which divides the reference signal OSC1 that is generated by the oscillator circuit A 101 to the prescribed frequency and by the wave-shaping circuit 103, which shapes the resulting signal to obtain the SP signal.

Figure 6:
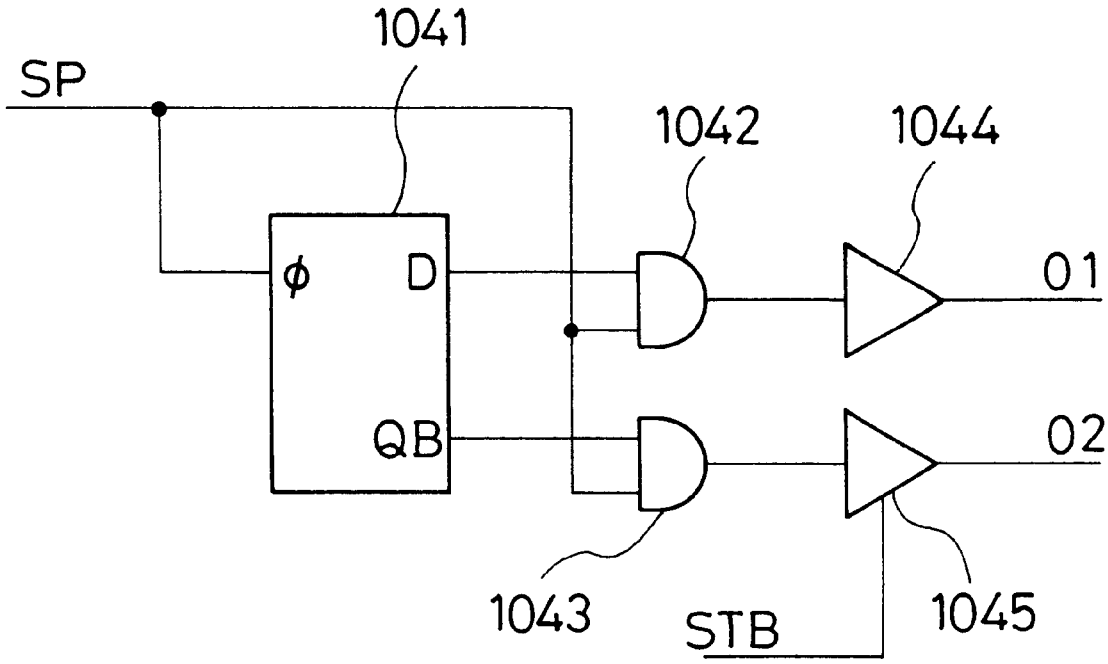
FIG. 6 is a block diagram that shows the circuit configuration of a motor driver of an electronic watch according to the present invention.

FIG. 6 is a circuit diagram that shows the configuration of the motor driver 104. In FIG. 6, the reference numeral 1041 denotes a toggle-type (T-type) flip-flop, 1042 and 1043 are AND circuits, 1044 is a motor buffer, and 1045 is a motor buffer, the output of which goes into the high-impedance state when the signal STB is at the high level.

The output of the flip-flop 1041 inverts at the falling edge of the SP signal. The signal SP is output alternately from the AND circuits 1042 and 1043, the result being that the SP signal is output alternately to 01 and 02. When the SP signal is output alternately to 01 and 02, the motor rotates so as to drive the hands of the watch 1.

In this embodiment, in the same manner as in the prior art example, the SP driving signal is used as a timing signal. Therefore, the wave-shaping circuit 103 functions as the timing signal generation means.

When data is transferred to the analog watch 1 from the data transmitting unit 2, with the motor drive coil 12 and transmitting/receiving coil 22 in mutual proximity, when the switch 210 is set to on, the signal E, which is the QB output of the D flip-flop 211, changes to the high level, thereby activating the control circuit 204.

In this condition, when the motor drive signal SP is output and current flows in the motor drive coil 12, the timing signal TX is output from the motor drive coil 12 as a magnetic signal. This timing signal TX is received by the transmitting/receiving coil 22 and sent to the receiving circuit 208, which outputs a trigger signal TG when it receives this timing signal TX.

With the control circuit 204 activated, when it receives the trigger signal TG it sets the reset signal Rst to the low level. As a result, the reset condition of the frequency divider circuit B 202 is cancelled, so that the frequency divider B 202 performs operation so as to frequency-divide the oscillation signal that is output by the oscillator circuit B 201.

Let us consider the case in which the frequency of the squarewave Fdiv output from the frequency divider circuit B 202 is f Hz. If the bandpass filter 203 is configured so as to have a pass frequency that is the same as the frequency F Hz of the squarewave Fdiv, a sinewave Fsin is output from the bandpass filter 203.

Figure 4:
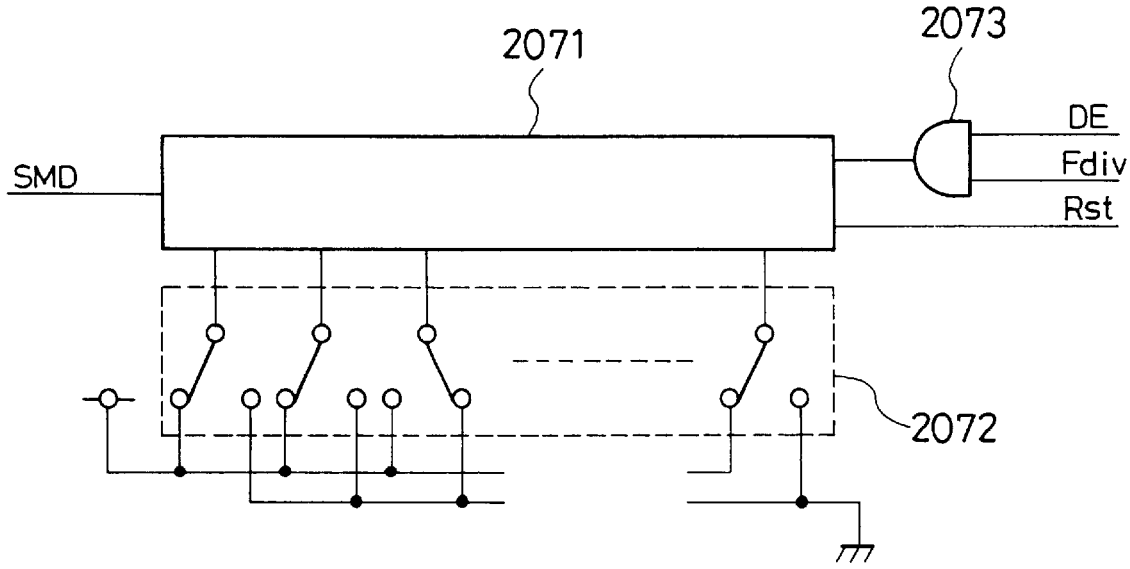
FIG. 4 is a block diagram that shows the circuit configuration of a transmitted data generation circuit of the data transmitting unit of the present invention.

The transmitted data generation circuit 207 is configured as shown in FIG. 4. In FIG. 4, the reference numeral 2071 denotes a shift register, 2072 is a switch group for the purpose of setting 8 bits of transmitted data, and 2073 is an AND circuit. With the Rst signal in the high state, the shift register 2071 is preset to the setting data established by the switch group 2072.

The control circuit 204 outputs a transmitting timing signal DE at a high level starting at time T1, which occurs at a given amount of time after it receives the trigger signal TG and ending at a time T2. During the time from T1 to T2, 8 cycles of the signal Fdiv are output.

When the transmitting timing signal DE changes to the high level, the squarewave Fdiv is input as a clock to the shift register 2071.

The shift register 2071 outputs the transmitted data signal, previously set, as the data signal SMD, in synchronization with the falling edge of the squarewave Fdiv.

Figure 5:
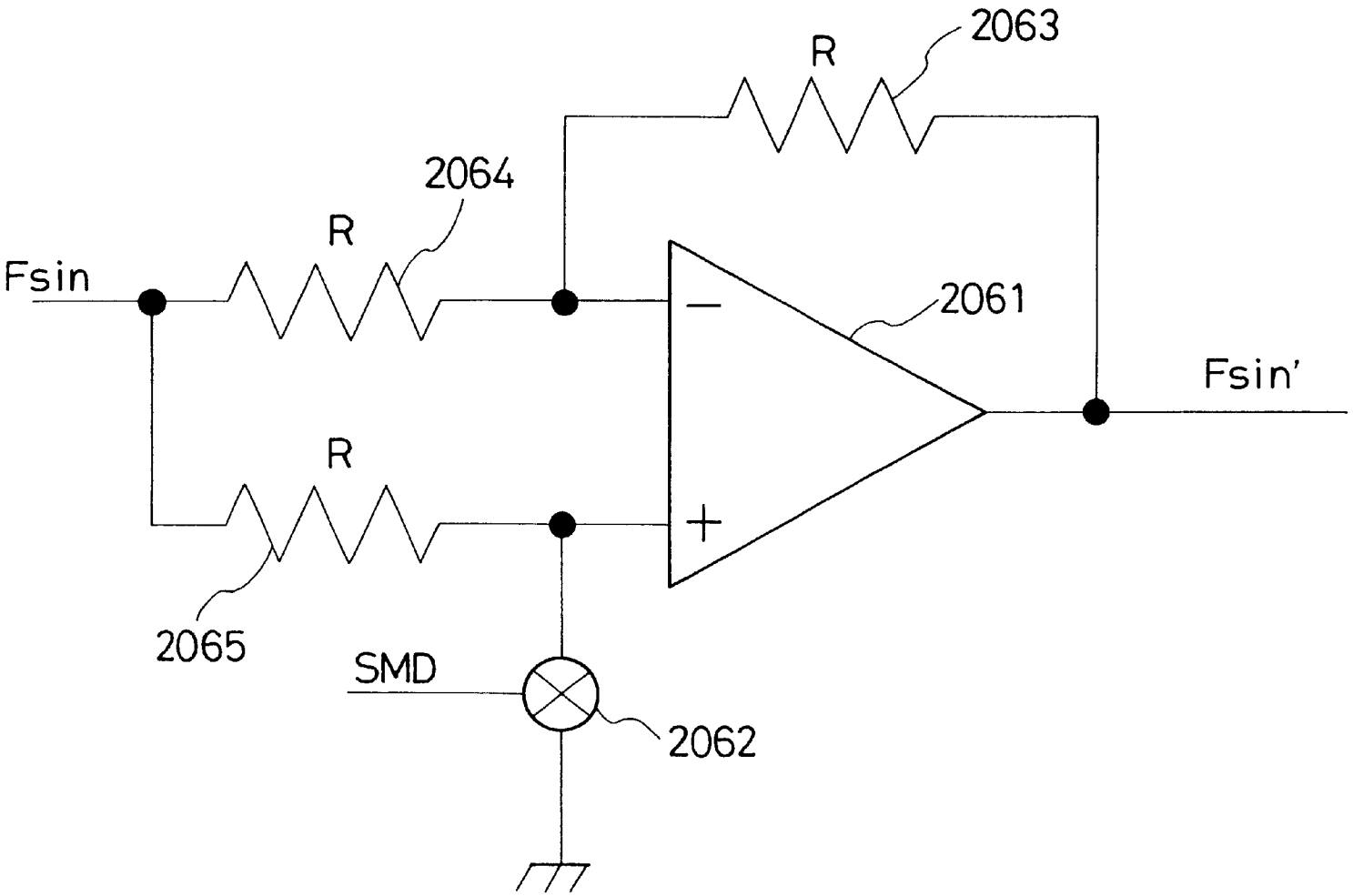
FIG. 5 is a block diagram that shows the circuit configuration of a phase inverter circuit of the data transmitting unit of the present invention.

The phase inverter circuit 206 has the circuit configuration shown in FIG. 5, in which the reference numeral 2061 denotes an operational amplifier, 2062 is a switch that is on when the data signal SMD is high and off when the data signal SMD is low, and 2063 through 2065 are resistances of the same resistance value R.

The circuit of FIG. 5 operates as a voltage follower when the switch 2062 is on, and operates as an inverter when the switch 2062 is off. Therefore, with the data signal SMD in the high state, the signal Fsin that is input to the phase inverter circuit 206 is output in the same phase as Fsin, and when the data signal SMD is in the low state, the Fsin that is input to the phase inverter circuit 206 is output in the inverted phase as Fsin'.

That is, Fsin is output by the phase inverter circuit 206 as Fsin', the phase of which is adjusted by 180 degrees, in accordance with the state of the data signal SMD.

At the mask circuit 205, the Fsin' signal is passed as the signal Fsen during the period in which the transmitting timing signal DE is high. This signal Fsen is sent to the transmitting/receiving coil 22 via the driver circuit 209, and is output as the transmitted signal DX.

At timing T2 the control circuit 204 sets the timing signal DE to the low level, and sets the Rst signal to the high level. When the Rst signal changes to the high level, the QB output of the D flip-flop 211 changes to the low level, and the control circuit 204 goes into the inactive state.

A reset is also applied to the frequency divider circuit B 202, and the data transmitting unit 2 ends its operation.

Next, the procedure by which the analog watch 1 receives the data signal DX that is output from the data transmitting unit 2 will be described, using the timing diagram of FIG. 12.

The motor drive signal SP is output and reception of data starts after the elapse of a given time T1.

After the additional time of ¼period of the signal Fdiv has elapsed after the timing T1, corresponding to the timing of T3, the timing control circuit 105 outputs a high-level signal of STBF, which is a data receiving timing signal, and after the further additional time of ¾of the period of the signal Fdiv has passed that corresponds to the timing F4, the timing control circuit 105 outputs a high-level signal of STBB, both of these signals being output with a width of ΔT.

When the STBF and STBB signals change to the high level, the output of the motor buffer 1045 goes into the high-impedance state, at which time, as described below, the data signal DX is output from the data transmitting unit 2.

If the motor buffer 1045 was in the high-impedance state during the period of transmitting the data signal DX, the voltage induced in the motor drive coil 12 of 02 by the data signal DX is as shown as Vr' in FIG. 12.

However, because the motor buffer 1045 actually goes into the high-impedance state only when either the STBF or the STBB signal is at the high level, and because at these times the output of the motor buffer 1044 is low, it is not possible to detect a signal lower than the low level, the result being that a signal such as Vr is actually output at the 02 terminal, as shown in FIG. 12.

When the data receiving circuit 106 detects that Vr is high at the timing T3, that is, when STBF is high, it sets SBK to the low level. Therefore, after this time when the output of STBB is detected, the motor buffer 1045 does not go into the high-impedance state.

That is, the operation of receiving data is prohibited at the timing of STBB.

The data receiving circuit 106 continues the receiving operation at the timing of STBF.

In the case in which the transmitted data DX is the same phase as that during period A, Vr is detected as high, however, the signal DX is modulated by the data signal SMD.

Thus, when Fsin' is in the inverted phase, that is, the timing corresponding to the period C of FIG. 12, Vr is not detected in high state.

Therefore, by testing whether Vr is high or low at the timing of STBF, it is possible to receive the high and low levels of the transmitted data SMD.

Figure 7:
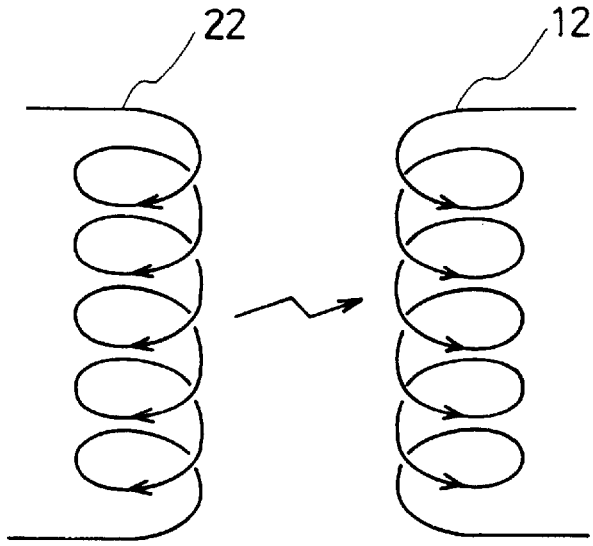
FIG. 7 is a drawing that shows the positional relationship between the motor drive coil and the transmitting/receiving coil according to the present invention.
Figure 8:
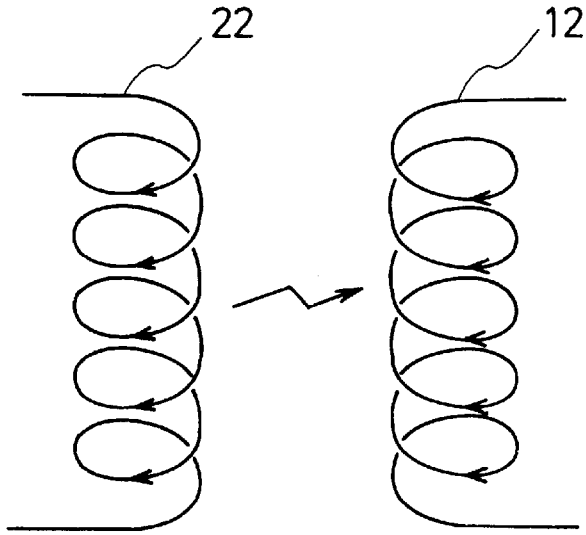
FIG. 8 is a drawing that shows the positional relationship between the motor drive coil and the transmitting/receiving coil according to the present invention.
Figure 13:
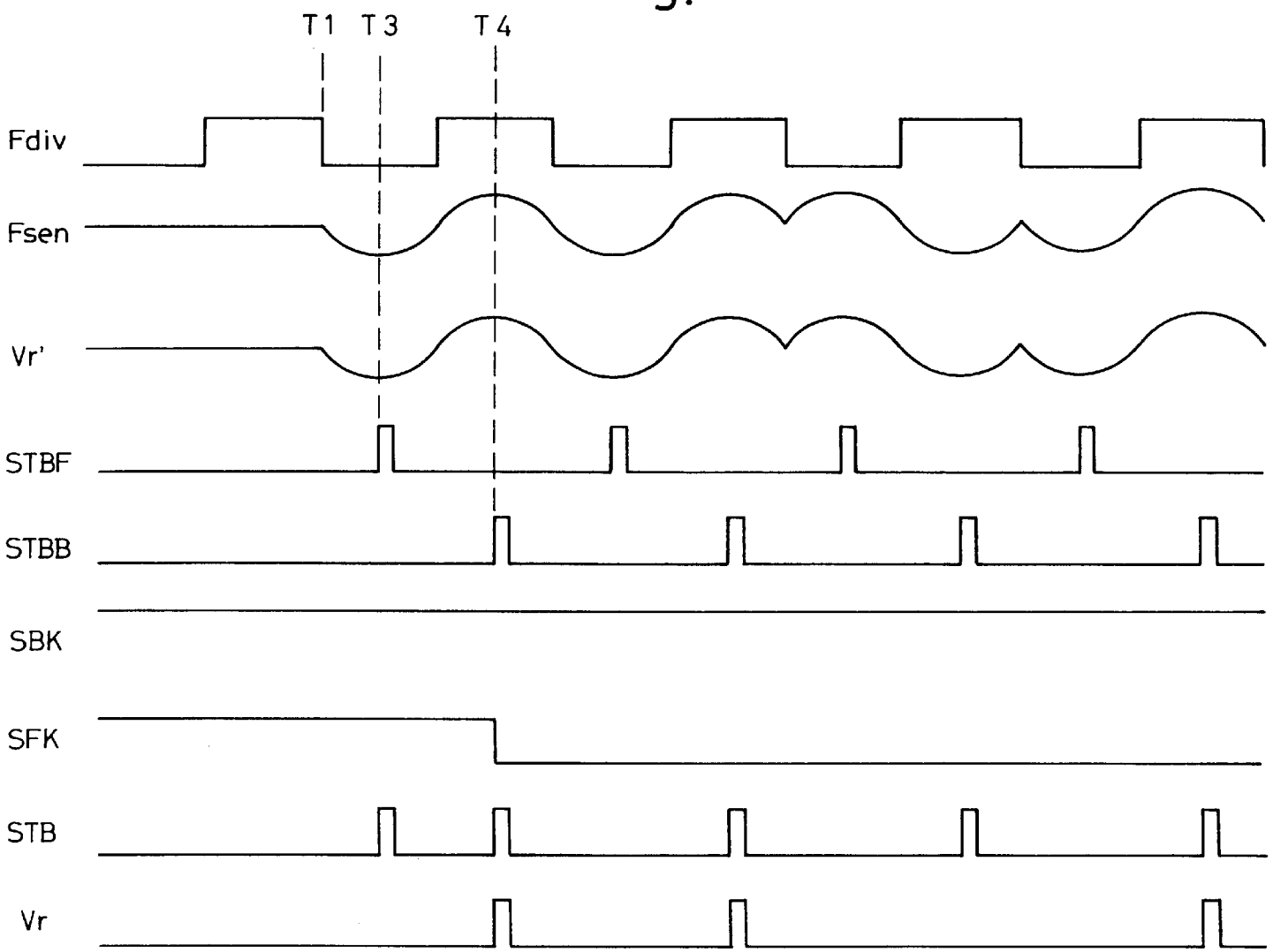
FIG. 13 is a timing diagram that show shows the operation of the present invention.

If the Fsen phase and the Vr' phase are related as shown in FIG. 12, and the positional relationship between the motor drive coil 12 and the data transmitting/receiving coil 22 is as shown in FIG. 7, when the positional relationship between the motor drive coil 12 and the data transmitting/receiving coil 22 is as shown in FIG. 8, the phase relationship between Fsen and Vr' is as shown in FIG. 13.

In the above-noted case, the Vr signal level at the timing of the STBF signal does not change to high level and changes to high level at the timing of the STBB signal, at which time the data receiving circuit 106 changes signal SFK to the low level.

Therefore, when after this timing, STBF changes to high level the motor buffer 1045 does not go into the high-impedance state, at the timing in which the signal STBF goes up to high level.

The receiving of data can be performed in the same manner as described earlier, by making a test of the Vr signal level at the timing of the STBB signal.

In accordance with this system, therefore, it is possible to perform reliable receiving of data, regardless of the relative magnetic positional relationship between the motor drive coil 12 and the transmitting/receiving coil 22.

Figure 14:
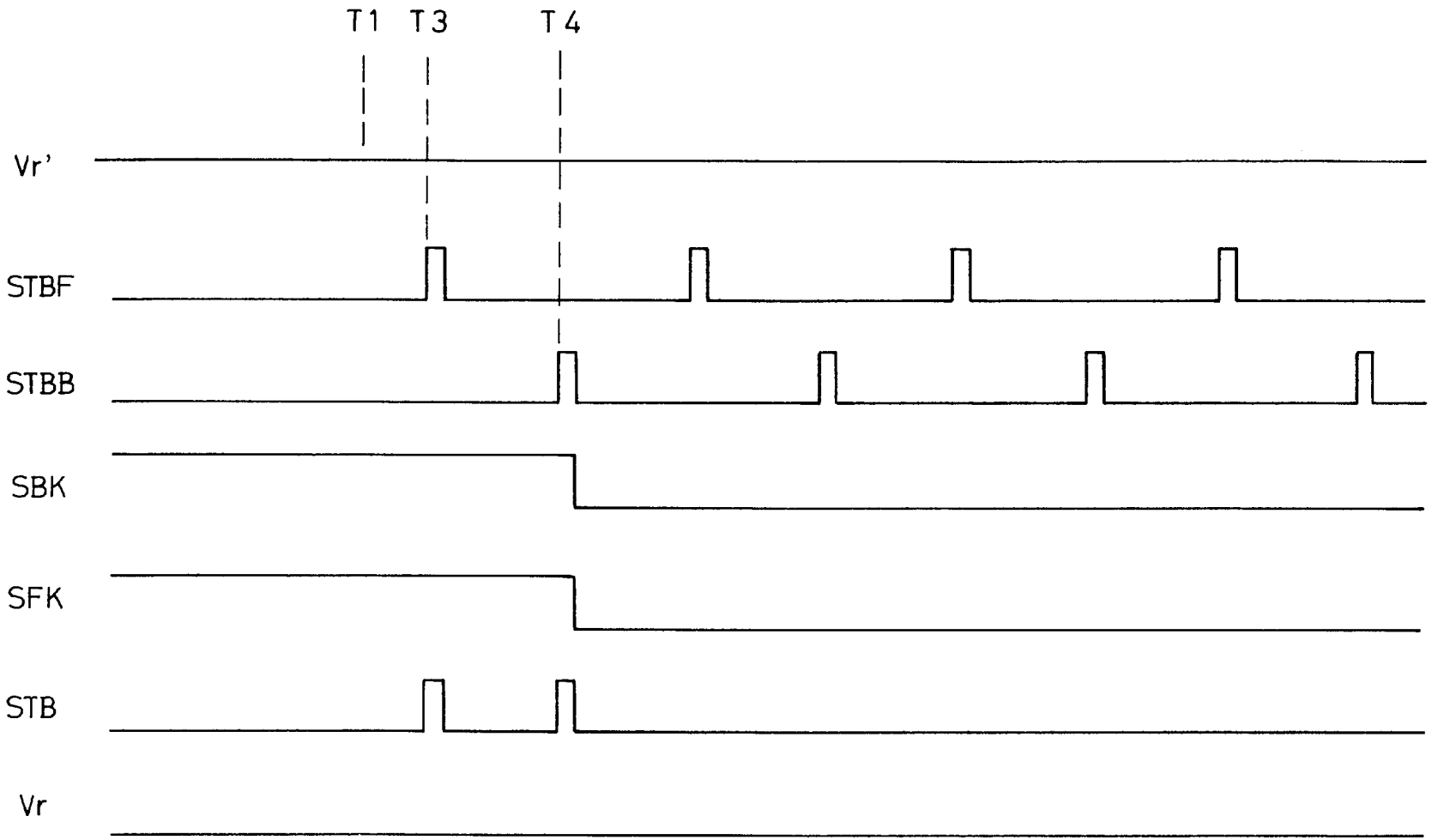
FIG. 14 is a timing diagram that show shows the operation of the present invention.
Figure 15:
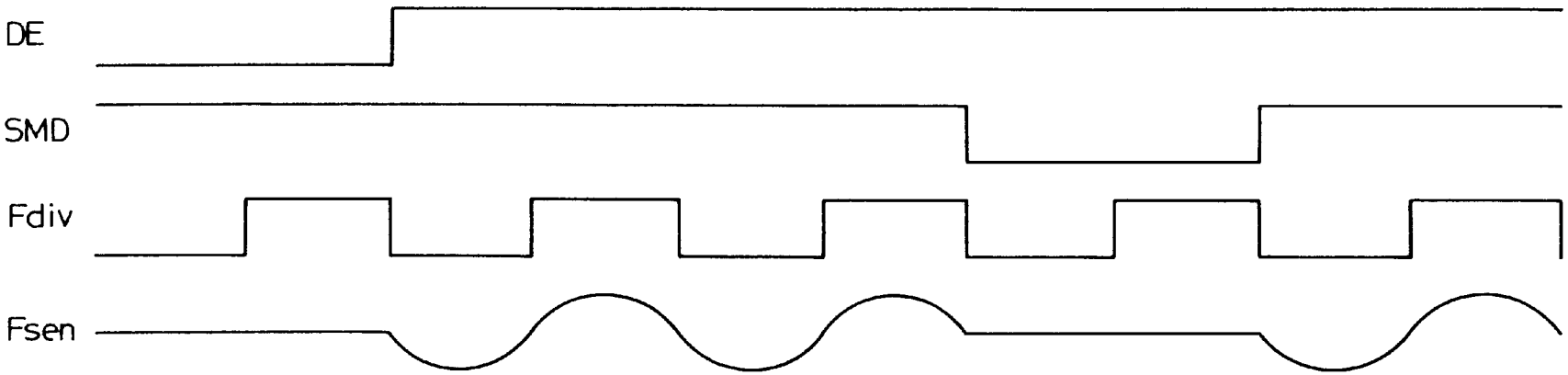
FIG. 15 is a timing diagram that show shows the operation of the present invention.

If the data receiving circuit 106 does not detect the high level of the Vr signal at timing of the both signals STBF and STBB during the A intervals, in FIG. 12, both SFK and SBK are made low level, as shown in FIG. 14, thereby prohibiting subsequent receiving operation.

Even though in the case in which, by setting at least one end of the motor drive coil to high impedance at the timing of the data receiving timing and the transmitted output of the data transmitting unit 2 is made small or in the case in which the distance between the analog-type watch 1 and the data transmitting unit 2 is great, so that the received signal level is small, it is possible to receiving good data.

In an analog-type watch in which the hand is performed in stepping operation, the ends of the motor drive coil 12 are normally shorted during driving of the motor, that is, the two ends of the motor drive coil 12 are maintained at the same potential by the motor buffer. This is done to prevent the motor from being caused to rotate by an externally applied shock.

While an electromotive force is generated when an attempt is made by an external force to rotate the motor, because it flows in the motor coil, an opposing force acts in the opposite direction of the external force that attempts to rotate the motor.

This is the so-called electromagnetic breaking effect and, with the output of the motor buffer 1045 in the high-impedance state when data is being received, the current flow path is cutoff, so that this electromagnetic breaking effect does not occur, thereby reducing the immunity of the motor to external shock.

Therefore, the timing of the receiving of data, that is, the period ΔT, during which the motor buffer 1045 is in the high-impedance condition, should be made as short as possible. Using the means described as part of the present invention, it is possible to establish the time period ΔT for detection as being a short period of time with respect to the data receiving rate.

By making the timing of the receiving of data intermittent, and making the time period other than the receiving timing, that is, other than the time during which the motor buffer 1045 is in the high-impedance condition, this being the time period during which the ends of the motor drive coil are shorted, be long with respect to the receiving time period, it is possible to avoid continuous periods during which electromagnetic breaking does not operate.

In this embodiment of the present invention, in a case in which a received signal is not detected at the first receiving timing, subsequent detection is not performed, so that unwanted detection time is not provided. It is clear that the above-noted measures not only improve the immunity to shock, but also has a great effect in preventing erroneous data reception.

Figure 9:
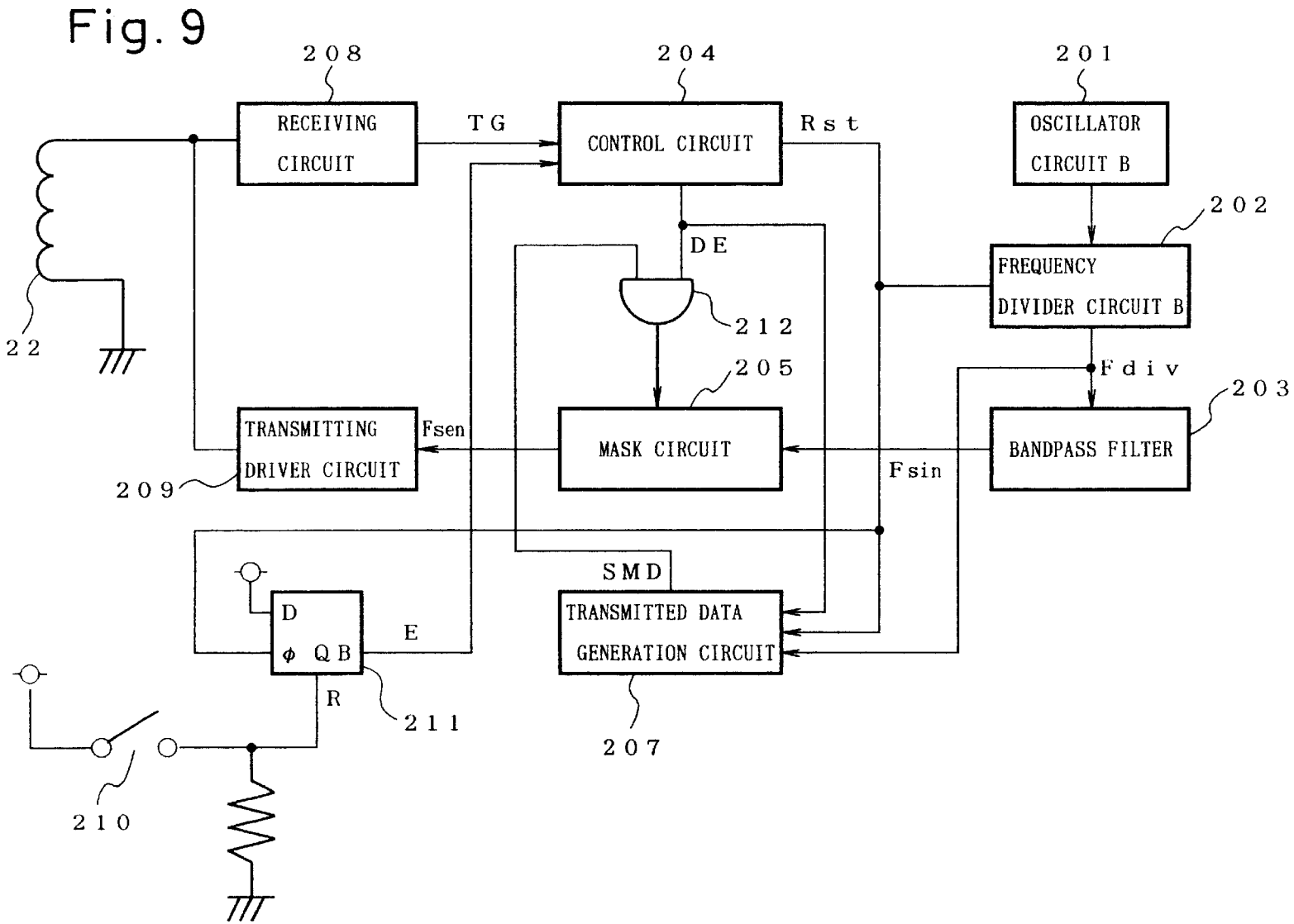
FIG. 9 is a block diagram that shows the circuit configuration of another data transmitting unit of the present invention.

In this embodiment of the present invention, the data signal is phase modulated by a phase-inverting circuit, and by using the circuit configuration as shown in FIG. 9, the transmitted waveform is as shown in FIG. 16, the result being data transmission by amplitude modulation.

FIG. 9 is a partial variation on the circuit that of FIG. 3, in which the reference numeral 212 denotes an added AND gate, and from which the phase-inverting circuit 206 has been removed.

According to this circuit configuration, in the period of time during which the data signal SMD is low level, a signal is not output from the signal Fsen', this being the so-called amplitude modulation condition, and in the case in which the circuit configuration of FIG. 9 is adopted as well, there is no change in the form of receiving performed by the analog-type watch 1. Therefore, by making the phase-inverting circuit unnecessary, it is possible to simplify the circuit configuration of the data transmitting unit 2.

Additionally, in this embodiment of the present invention, the transmitting frequency of the transmitted signal used in the data transmitting unit 2 is fHz, and it is desirable that this frequency be 1/N times 32,768 Hz, where N is an integer.

Because this frequency is the frequency that is used as the basic frequency for almost all analog-type watches, by using a frequency of 1/N times this frequency, where N is an integer, the need to generate a separate frequency signal in the electronic circuitry 11 of the analog-type watch 1 is eliminated, thereby enabling a simplification of the circuit.

Although this embodiment uses a motor drive pulse as the timing signal, there is no reason why a dedicated timing signal could not be used for other timing, although it is desirable that the timing signal be continuously output at intervals, without making performing any operation in the analog-type watch.

By doing this, the need to perform an operation at the watch when transferring data is eliminated, this representing a great advantage in terms of ease of operation.

Furthermore, while this embodiment uses a motor drive coil of the analog-type watch as a means for sending a timing signal, it is easy to apply this to a watch that has a different coil.

For example, in a beeper circuit for the purpose of generating an alarm sound, when a voltage is applied to a piezo-electric element, a voltage-stepup coil is often used.

By using the voltage-stepup coil in place of the motor drive coil as a means for sending the timing signal, it is possible to perform the same type of operation as described for the case of the above-noted example.

In the example used in describing this embodiment of the present invention, because it is possible to use the same frequency as the reference frequency for transmitting data, that is, the carrier frequency, and as the data transmission rate, it is possible to perform high-speed data transmission at a relatively low carrier frequency.

In the data transmitting unit 2 in this embodiment, the receiving coil for the purpose of receiving the timing signal is used also as one of the transmitting coils for sending data.

By doing this, although low-cost implementation of the data transmitting unit is possible, the drawbacks described below occur.

The timing signal TX that is output from the analog-type watch 1 is inevitably a low-output signal, because of the nature of the analog-type watch. If the timing signal TX is output at a high level, the result would be a high current flowing in the motor drive coil 12, this causing the analog-type watch to have a large power consumption, which reduces the amount of operating time thereof.

Therefore, the timing signal that is sent from the analog-type watch 1 is of a low level, and in order to reliably receive this low-output signal, it is necessary to have a receiving coil in the data receiving means 2 that has high sensitivity, enabling detection of even a minute magnetic signal.

In order to improve the sensitivity of the receiving coil, the number of turns of the coil can be increased, or a core can be provided in the coil, ferrite or other high-permeability material being usable as the material for this core.

In the case in which measures are taken to achieve a high-sensitivity receiving coil, the reactance thereof inevitably increases, and if this coil is used also for transmitting, the accompanying increase in self-inductance of the coil would make it difficult to perform either phase or amplitude modulation if, as in the case of this embodiment, the carrier frequency and the data transmission rate are the same or close to the same.

To alleviate these drawbacks, therefore, it is desirable that both a high-sensitivity receiving coil and a low-reactance transmitting coil be provided.

FIG. 16 shows the second embodiment of the present invention, in which a receiving coil and a transmitting coil are provided independently.

Specifically, reference numeral 23 is a receiving coil, and 24 is a data transmitting coil.

Because the timing signal from the analog-type watch 1 and the method of sending data from the data transmitting unit are the same as described above, they will not be explicitly repeated hereinunder.

Figure 17:
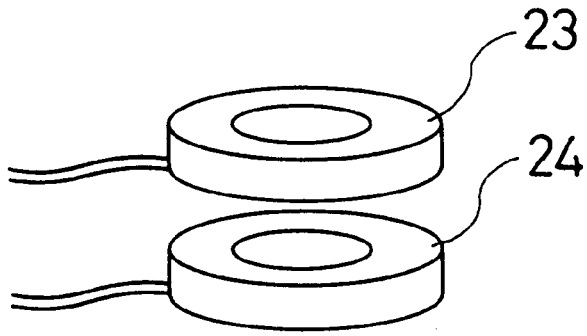
FIG. 17 is a drawing that shows the positional relationship between the transmitting coil and the receiving coil in the present invention.

In a configuration such as that of the second embodiment, in which an independent receiving coil 23 and data transmitting coil 24 are provided, it is desirable that the coils be toroidally formed, as shown in FIG. 17, and that the centers thereof be disposed on one and the same axis.

Figure 18:
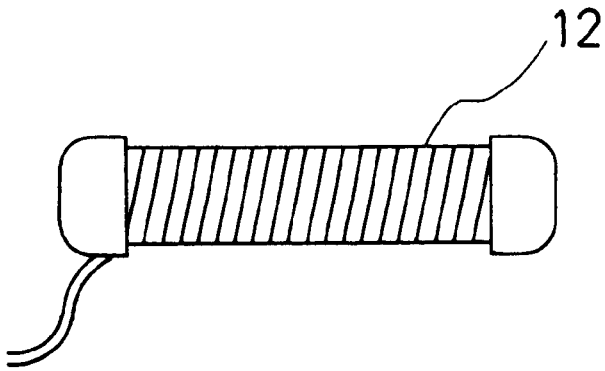
FIG. 18 is a drawing that shows the motor drive coil in the present invention.
Figure 19:
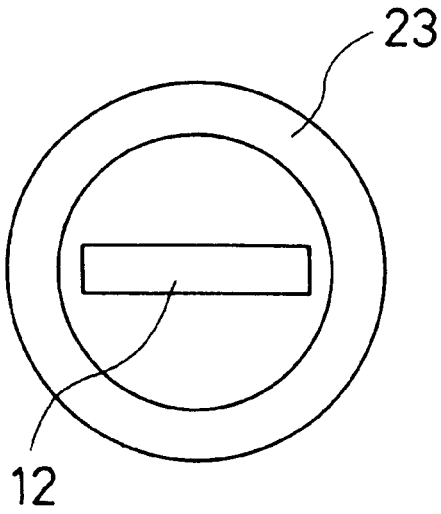
FIG. 19 is a top plan view that shows the positional relationship between the motor drive coil and the transmitting/receiving coil in the present invention.
Figure 20:
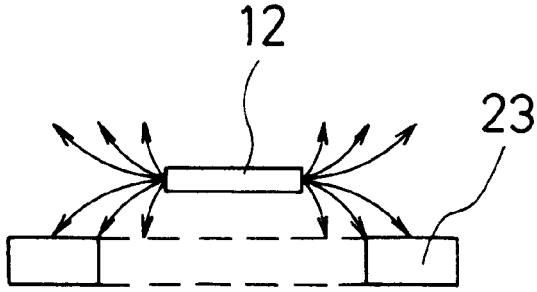
FIG. 20 is a side view that shows the magnetic positional relationship between the motor drive coil and the receiving coil in the present invention.

The motor drive coil 12 of the analog-type watch is usually bar-shaped, as shown in FIG. 18. When the timing signal TX sent from the motor drive coil 12 is received by the receiving coil 23, in the case in which the positional relationship between the receiving coil 23 and the motor drive coil 12 is as shown in FIG. 19, the magnetic force lines generated by the motor drive coil 12 are as shown in FIG. 20, the result being that an electromotive force is not generated in the receiving coil 23.

Figure 21:
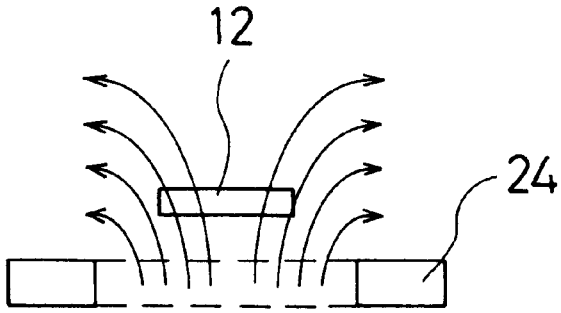
FIG. 21 is a side view that shows the magnetic positional relationship between the motor drive coil and the receiving coil in the present invention.

In the case in which the same positions are taken by the data transmitting coil 24 and the motor drive coil 12, the magnetic lines of force are as shown in FIG. 21, and it is not possible for the analog-type watch to receive the output signal DX from the data transmitting unit 2.

Figure 22:
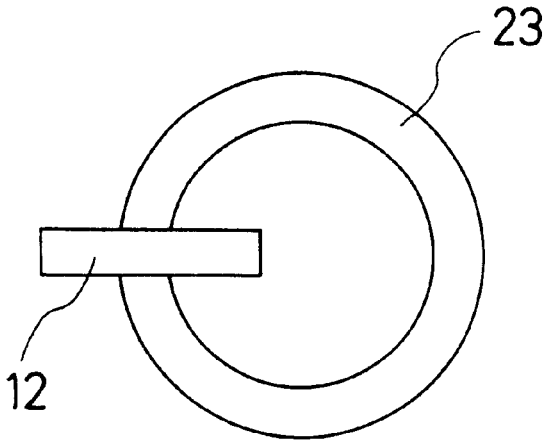
FIG. 22 is a top plan view that shows the positional relationship between the motor drive coil and the transmitting/receiving coil in the present invention.
Figure 23:
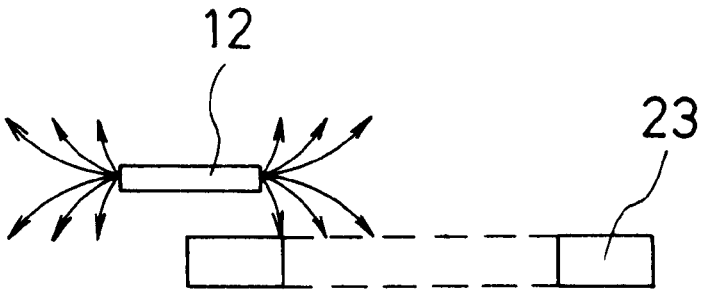
FIG. 23 is a side view that shows the magnetic positional relationship between the motor drive coil and the receiving coil in the present invention.

In contrast to this, in the case in which the receiving coil 23 and the motor drive coil 12 are positionally related as shown in FIG. 22, the magnetic force lines generated by the motor drive coil 23 are as shown in FIG. 23, and voltage is induced in the receiving coil 23 with the best efficiency.

Figure 24:
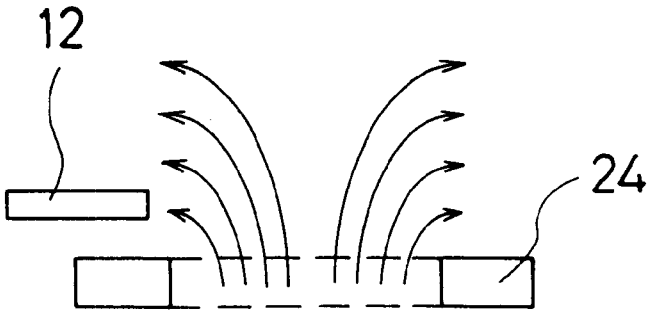
FIG. 24 is a side view that shows the magnetic positional relationship between the motor drive coil and the receiving coil in the present invention.

In the case in which the same positions are taken by the data transmitting coil 24 and the motor drive coil 12, the magnetic lines of force are as shown in FIG. 24, and the output signal DX from the data transmitting unit 2 is received well by the analog-type watch 1.

By making the receiving coil 23 and the data transmitting coil 24 mutually independent, and by further by disposing the centers thereof on one and the same axis, in the case in which the positional relationship between the motor drive coil 12 and the receiving coil 23 and data transmitting coil 24 is such that it is possible for the data transmitting unit 2 to receive the timing signal TX, it is possible to perform a setting to the effect that enables the analog-type watch 1 to receive data.

Therefore, it is possible to prevent the condition in which it is not possible for the analog-type watch 1 to receive the data signal DX, even if the reception of the timing signal TX has been confirmed at the data receiving means 2.

Additionally, by adjusting the receiving sensitivity of the receiving circuit 208 of the data transmitting unit 2 and the transmitted output of the transmitting driver circuit 209, and by making the distance from which it is possible for the analog-type watch 1 to receive the transmitted signal DX that is output from the data transmitting unit 2 so that it is greater than the distance over which it is possible for the data transmitting unit 2 to receive the timing signal TX that is output from the analog-type watch 1, it is possible to reliably prevent a condition in which it is not possible to receive the data signal DX at the analog-type watch 1, even when reception of the timing signal DX is verified at the data receiving means 2.

Figure 25:
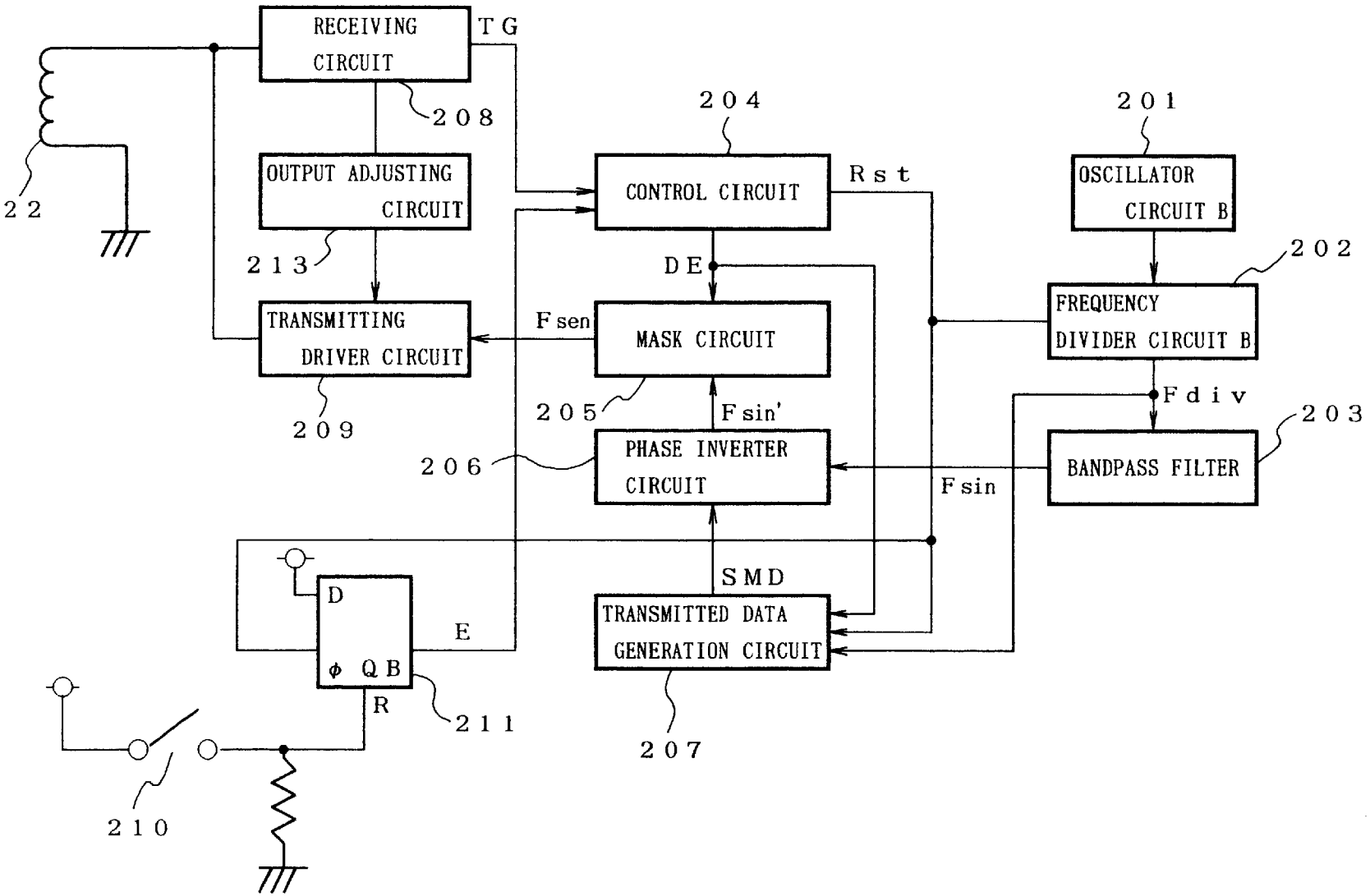
FIG. 25 is a block diagram that shows the circuit configuration of another data transmitting unit of the present invention.

Additionally, it is possible to perform reliable operation by adopting the circuit configuration that is shown in FIG. 25. FIG. 25 is the circuit that is shown in FIG. 3, with the addition of an output adjusting circuit 213.

The output adjusting circuit 213 is provided, this circuit, in response to the strength of the received signal that is received at the receiving circuit 20, performing adjustment of the strength of the transmitted signal DX that is output from the transmitting driver circuit 209, so that the output of the transmitting driver circuit 209 is made large when the level of the received signal is small and made small when the level of the received signal is large, the result being further reliability of operation.

Next, an embodiment of the present invention for the purpose of achieving operation with a further improvement in reliability will be described, with reference being made to relevant drawings.

Figure 26:
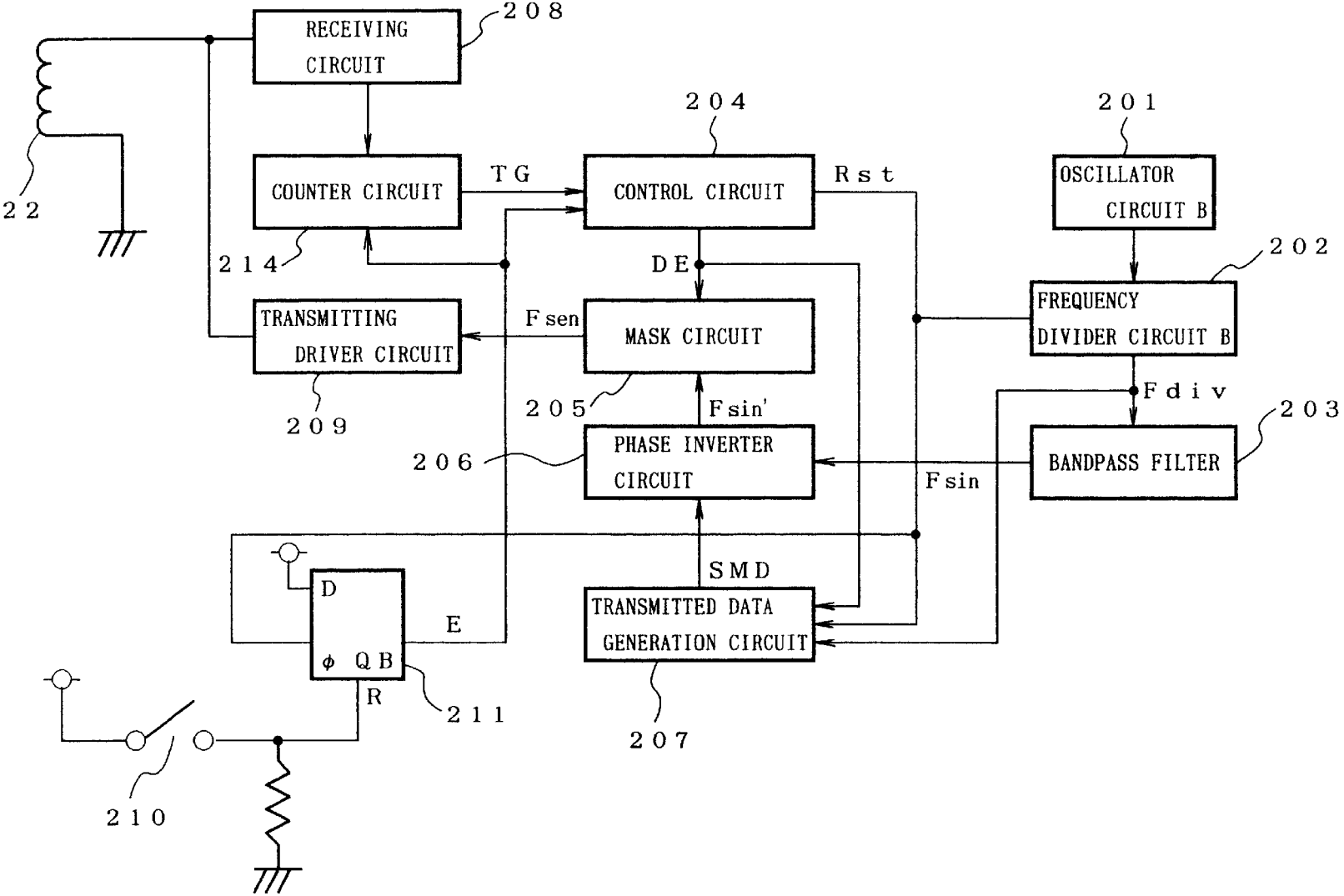
FIG. 26 is a block diagram that shows the circuit configuration of another transmitting unit of the present invention.

FIG. 26 is the circuit that is shown in FIG. 3, with a slight modification of the data receiving means 1, 214 being a counter circuit.

As described with regard to the first embodiment, in this embodiment as well, when the switch 210 switches to the high level, operation begins, at which time if the timing signal TX is being output, it can be envisioned that the data transmitting timing T1 is skewed from the desired timing.

In the present invention, the counter circuit 213 is caused to operate after the switch 210 changes to the high level and, at the point at which this counter circuit 213 detects the timing signal TX sent from the analog-type watch 1 two times, the operation enable signal E of the control circuit 204 is set to high level.

Because operation after that point is the same as was described with regard to the prior art, it will not be repeated-hereinunder.

In accordance with the present invention, it is possible to perform reliable data transmission, regardless of the on timing of the switch 210, which is the switch that causes the data transmitting unit 2 to operate.

In a data transmitting/receiving system of the above-noted electronic watch, in the case in which prescribed data is received at the electronic watch 1 side from the data transmitting unit 2, after, for example, storing this data into an appropriate memory circuit, the data is read out at an appropriate timing, so as to execute adjustment of the displayed time, adjustment of the frequency, or adjustment of cadence.

Because the above-noted operation is known, it will not be described in detail herein. However, one example thereof will be generally described.

First, the configuration of an electronic watch of the past which performs memory overwriting will be described, with reference to FIG. 28, using an example in which the cadence is controlled by memory.

Figure 28:
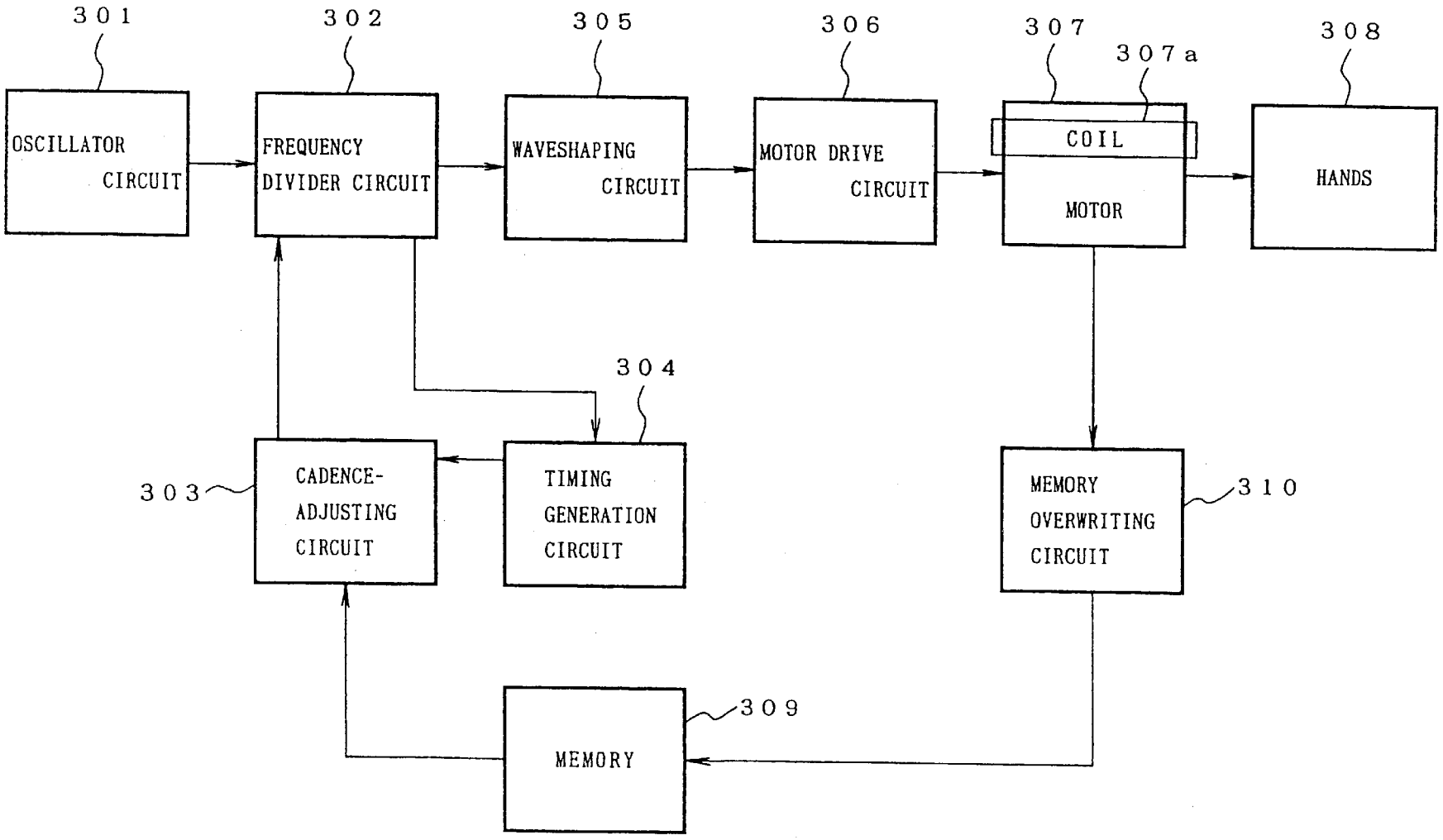
Fig. 28 (Prior Art)
FIG. 28 is a circuit block diagram of a memory switching device that illustrates on embodiment of the prior art.

FIG. 28 is a circuit block diagram of an electronic watch of the past which performs memory overwriting, in which the reference numeral 301 is an oscillator circuit that oscillates to generate a reference signal, 302 is a frequency divider circuit that divides the frequency of the signal of the oscillator circuit 301, 303 is a cadence-adjusting circuit that adjusts the cadence by logically operating the frequency divider circuit 302, and 304 is a timing generation circuit that establishes the operation timing of the cadence-adjusting circuit 303. The reference numeral 305 denotes a waveshaping circuit that generates a motor drive signal by using a signal of the frequency divider circuit 302, 306 is a motor drive circuit for the purpose of driving the motor using a signal of the waveshaping circuit 305, 307 is a motor that is driven by the motor drive circuit 306, 307*a* is a coil that is part of the motor 307, and 308 are the hands that are operated by the motor 307.

The reference numeral 309 denotes a memory that establishes the amount of cadence adjustment of the cadence-adjusting circuit 303, 310 is a memory overwriting circuit that receives data from outside the watch by using an electromotive force in the coil 307*a* when a magnetic field is generated outside the watch, and that overwrites the data contents of the memory 309 with the received data.

Next, the configuration of the apparatus for the purpose of memory overwriting will be described, with reference being made to FIG. 29.

Figure 29:
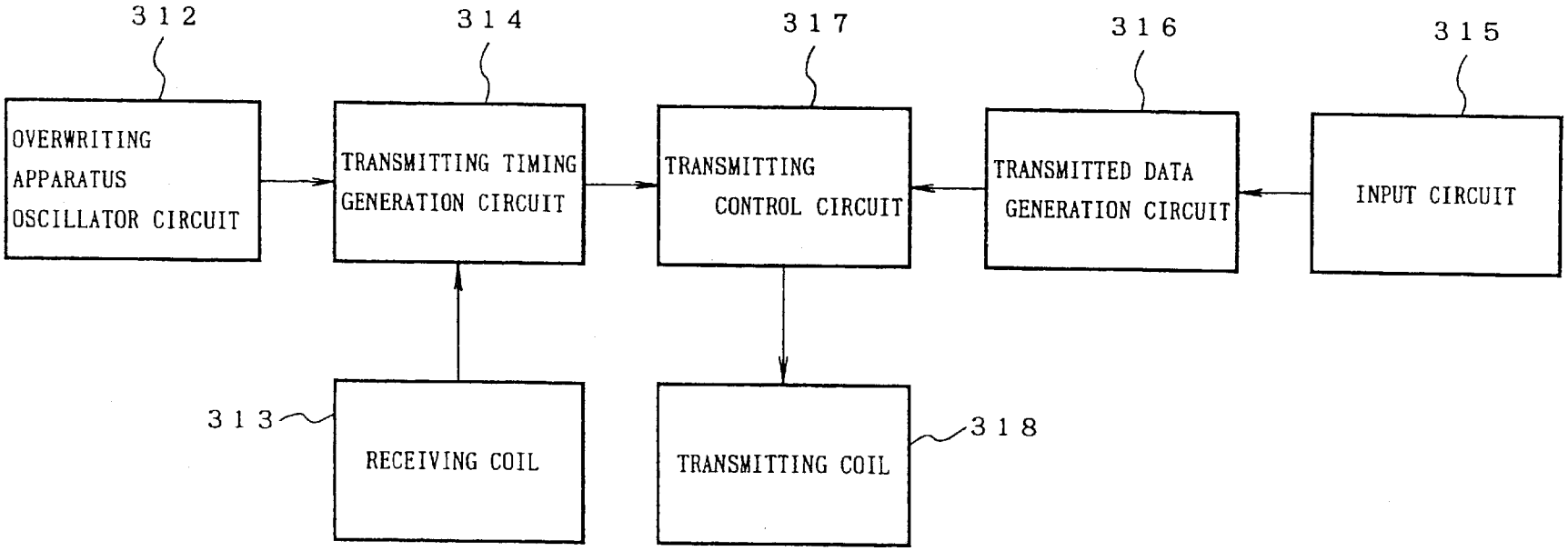
Fig. 29 (Prior Art)
FIG. 29 is a circuit block diagram of an electronic watch that illustrates an embodiment of the prior art.

In FIG. 29, the reference numeral 312 denotes an overwriting apparatus oscillator circuit, 313 is a receiving coil that detects a change in a magnetic field that is generated when the motor 307 is operated, and 314 is a transmitting timing generation circuit that counts a given amount of time from the time that of the detection by the receiving coil 313 of a change in the magnetic field of the motor coil 307.

The reference numeral 315 denotes an input circuit that inputs the amount of cadence adjustment, 316 is a transmitted data generation circuit that converts the data of the input circuit 315 to binary form, 317 is a transmitting control circuit that sends data of the transmitting data generation circuit 316, in accordance with the timing of the transmitting timing generation circuit 314, and 318 is a transmitting coil for the purpose of sending the signal of the transmitting control circuit 317 as a change in a magnetic field.

Next, the operation of an electronic watch of the past which performs memory overwriting will be described, with reference to FIG. 28 and FIG. 29.

First, the circuitry that performs cadence adjustment will be described. If the timing generation circuit 304 generates a timing of, for example, 1 minute, the cadence-adjusting circuit 303 operates once each 1 minute, applying either resetting or setting to the various frequency dividing stages of the frequency divider circuit 302, based on the contents of the memory 309, thereby adjusting the cadence.

Next, the circuit that performs memory overwriting will be described. When the motor 307 is driven by a signal from the motor drive circuit 306, a magnetic field is generated. The change in this magnetic field is detected by the receiving coil 313 of the memory overwriting apparatus, and the transmitting timing generation circuit 314 is started.

The transmitted data generation circuit 316 converts the cadence adjustment data that was priorly input to the input circuit 315 to binary data, and the transmitting control circuit 317 performs transmission by causing a magnetic field to be generated in the transmitting coil 318, in synchronization with the timing of the transmitting timing generation circuit 314.

At the watch side, the magnetic field that is generated in the transmitting coil 318 is detected by the coil 307*a* so as to receive data. The data that is received by the coil 3107*a* is written into the memory 309 by the memory overwriting circuit 319, thereby completing the overwriting of memory.

In the above-noted prior art, however, the cadence adjustment based on the new memory contents is performed by the cadence-adjusting circuit 303 after the timing generation circuit 304 operates, the result being that memory contents are not written with respect to previous measurements of cadence.

In the case in which the above-noted method is used to adjust cadence during production, it was at best possible to measure the cadence up until the timing generation circuit 304.

Accordingly, in another example of the present invention, which is made for the improvement of the above-noted problem, the cadence-adjusting circuit 303 is, thereby providing a data transmitting/receiving system for an electronic watch using a watch capable of immediate cadence adjustment by forcibly operated immediately after the overwriting of the memory 309.

Figure 27:
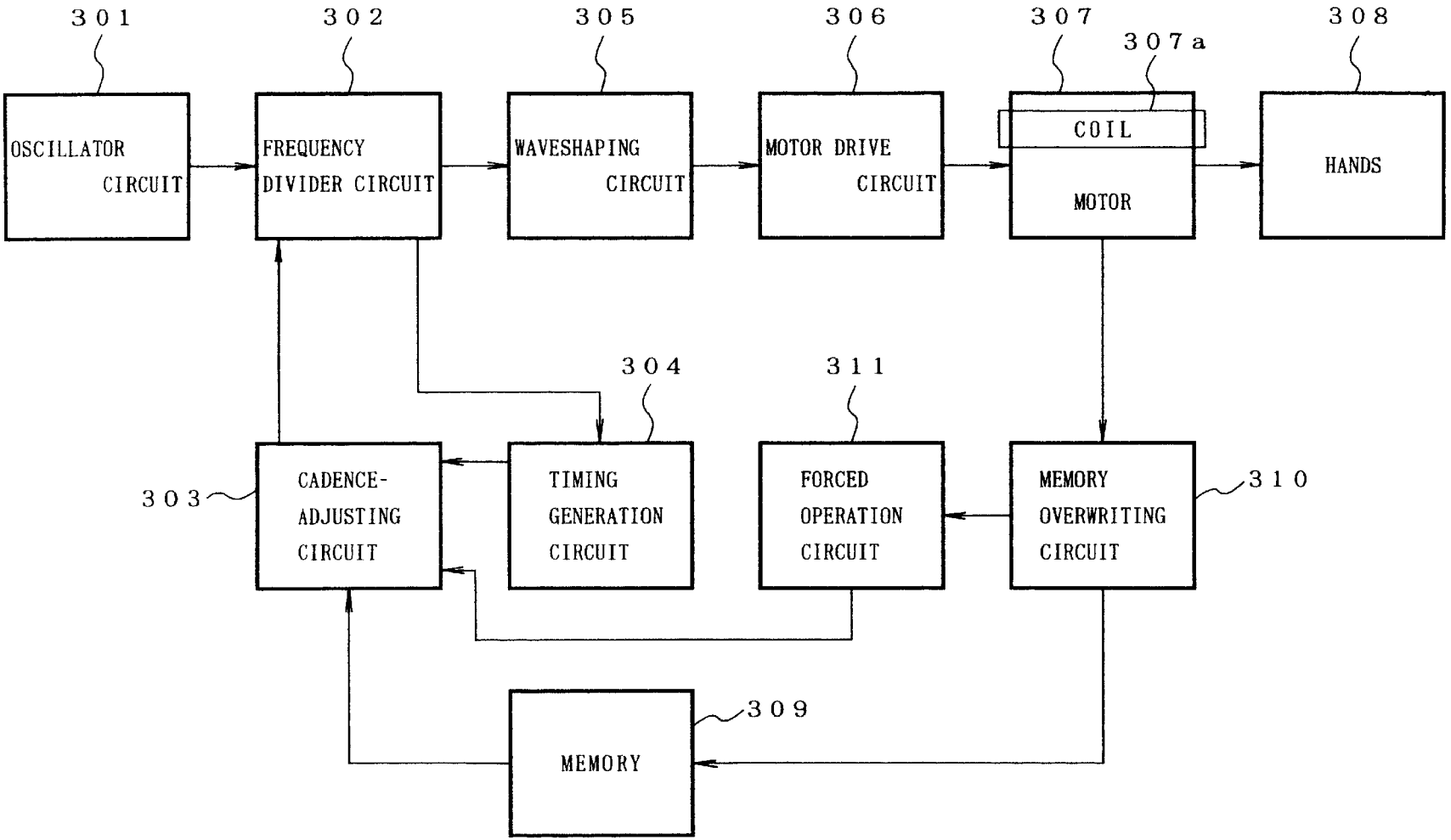
FIG. 27 is a circuit block diagram that shows a specific example of another electronic watch according to the present invention.

Specifically, in this example of the present invention, shown in FIG. 27, the electronic watch is provided with a forced operating circuit 311 that forcibly causes the cadence-adjusting circuit 303 to operate immediately after overwriting of the memory 309, so that the contents thereof are reflected by the cadence-adjusting circuit 303.

The above-noted example of the present invention is described in detail below, with reference being made to FIG. 27.

FIG. 27 shows a block diagram of an electronic watch that is used in a data transmitting/receiving system in the above-noted example of the present invention, and in this drawing elements that are the same as elements in FIG. 29 have been assigned the same reference numerals, and are not explicitly described herein.

In FIG. 27, the reference numeral 311 denotes a forced operation circuit for the purpose of forcing the cadence-adjusting circuit 303 to operate. The operation of this example of the present invention is described below, with reference being made to FIG. 27.

Specifically, when the memory overwriting circuit 310 overwrites the contents of the memory 309, the forced operation circuit 311 receives an overwriting completed signal from the memory overwriting circuit 310, at which point it forces the cadence-adjusting circuit to operate, regardless of the timing of the timing generation circuit 304.

By doing this, immediate after the memory contents are overwritten, it is possible perform cadence adjustment based on the new memory contents, and to measure cadence immediately.

The quantity that is controlled by memory is not limited to the cadence, and can be, for example, the alarm frequency or the sensor setting value.

According to the present invention as described in detail above, a system is provided in which transmission of data and the like can be done from a data transmitting unit 2 to an analog-type watch 1, and in which there is absolutely no influence therefrom with respect to the basic time-display function of the analog-type watch 1.

Additionally, because the present invention hand drive performs hand drive at a cadence that reflects memory contents-immediately after the memory contents are overwritten, it enables cadence measurement immediately after adjustment, making it effective for use in watch production.

That is, if a data transmitting/receiving system of an electronic watch according to the present invention is used, for example, in the case in which an internal oscillator circuit of the electronic watch or reference value of a time display circuit is to be set to a precise frequency, in the condition of a module or in the condition of a completed watch, it is possible to perform the above-noted adjustment without disassembling the above-noted module or completed watch, this representing a great effect in reducing the cost of production.

Furthermore, according to the present invention, even in the case in which an electronic watch that is to be inspected is placed in opposition to the above-noted data transmitting unit, there is no restriction with regard to the orientation of the watch, it being possible to perform the same type of operation regardless of the orientation thereof (that is, regardless of whether the orientations of the data transmitting unit coil and the coil of the electronic watch are the same or different), thereby enabling a simplification of the above-noted inspection process.

What is claimed is:

1. A data transmitting/receiving system which is configured by an electronic watch and a data transmittal unit, separate from the watch, which generates a data signal, a coil within said electronic watch being used by a data receiving means of said electronic watch to receive the data signal from said data transmitting unit, said electronic watch having a timing signal generation means, which generates a timing signal, and said data transmitting unit having a timing signal receiving means that receives a timing signal which is output from said timing signal generation means, said data transmitting unit transmitting the data signal to said electronic watch in coordination with a received timing signal, and said data receiving means in said electronic watch intermittently receiving data which is sent from said data transmitting unit in a time duration during which predetermined data is transmitted from said data transmitting unit.

2. A data transmitting/receiving system including an electronic watch, said system comprising:

an electric watch having a timing signal generation means for generating a timing signal; and a data transmitting unit, separate from the electric watch, which generates a data signal, said system being so configured that said data signal generated from said data transmitting unit is transmitted to said electric watch and received by a data receiving means of said electric watch utilizing a coil within said electric watch;

wherein said data transmitting unit has a timing signal receiving means that receives a timing signal which is output from said timing signal generation means while said data transmitting unit transmits the data signal to said electric watch in coordination with a received timing signal, and said data receiving means in said electric watch receives said data signal which is sent from said data transmitting unit only at predetermined intervals which corresponds to intervals during which said data signal is sent from said data transmitting unit, and further wherein said data receiving means stops further reception of data when the lack of data output from said data transmitting unit verified at a first data receiving timing within a present one of said intervals.

3. A data transmitting/receiving system of an electronic watch having a data transmitting unit that generates a data signal and a data receiving means that receives said data signal from said data transmitting unit, utilizing a coil within said electronic watch, said electronic watch comprising a timing signal generation means that generates a timing signal, said data transmitting unit further being provided with:

a timing signal receiving means that receives the timing signal that is output from said coil, so that said data transmitting unit transmits a data signal in synchronization with said received timing signal;

a receiving coil for receiving the timing signal; and a transmitting coil for transmitting data; and further wherein said transmitting coil has a reactance that is smaller than reactance of said receiving coil.

4. A data transmitting/receiving system according to claim 1 and 2, wherein the data signal that is generated from said data transmitting unit amplitude modulates an alternating magnetic signal with amplitude modulation or phase modulation.

5. A data transmitting/receiving system according to claim 4, wherein at a first receiving timing, said data receiving means performs a receiving operation at both a first pre-established phase position of said alternating current magnetic signal and a second pre-established phase position of said alternating current magnetic signal.

6. A data transmitting/receiving system according to claim 5, wherein said first phase position is in the range from 0 degrees to 180 degrees, and further where said second phase position is in the range from 180 degrees to 360 degrees.

7. A data transmitting/receiving system according to claim 6, wherein said data receiving means performs a receiving operation at a first receiving timing at the timing when the phase of said alternating current magnetic field is 90 degrees and when the phase of said alternating current magnetic field is 270 degrees.

8. A data transmitting/receiving system according to claim 4, wherein the data transmitting frequency of the data signal that is generated by said data transmitting unit is the same as the frequency of said magnetic signal.

9. A data transmitting/receiving system according to claim 5, wherein in a case in which data reception is verified at one of said phase positions at a first receiving timing, data receiving is caused to occur at said phase positions at a second and subsequent receiving timings, and data receiving is not performed at the other of said phase positions thereafter.

10. A data transmitting/receiving system according to claim 9, wherein when transmitted data from said data transmitting unit is detected by said data receiving means at a phase of 90 degrees of said alternating magnetic field, a detection operation is performed at only a phase of 90 degrees thereafter for subsequent detection timings, and wherein when transmitted data from said data transmitting unit is detected by said data receiving means at a phase of 270 degrees of said alternating magnetic field, a detection operation is performed at only a phase of 270 degrees thereafter for subsequent detection timings.

11. A data transmitting/receiving system according to claim 1 or 2, wherein the frequency of data transmission that is performed in the data transmitting unit is 1/N times 32768 Hz, where N is an integer.

12. A data transmitting/receiving system according to claim 1, claim 2, or claim 3, wherein said electronic watch is an analog-type electronic watch.

13. A data transmitting/receiving system according to claim 12, wherein said coil is a coil that is part of a motor for driving a hand of said electronic watch.

14. A data transmitting/receiving system according to claim 1, claim 2, or claim 3, wherein said coil is a coil for a beeper.

15. A data transmitting/receiving system according to any one of claim 1, 2, or 3, wherein the configuration is such that a transmitting power of said data transmitting unit is greater than the transmitting power of said electronic watch.

16. A data transmitting/receiving system according to any one of claim 1, 2, or 3, wherein said electronic watch comprises:

a memory capable of being overwritten;

means for overwriting said memory without making a terminal setting;

means for controlling a controlled quantity in accordance with the contents written into said memory; and means for generating timing for the purpose of periodically operating said control means, wherein a forced operation means is provided whereby, immediately after said memory is overwritten by said memory overwriting means, the results thereof are caused to be reflected in said control means, regardless of the timing generated by said timing generating means.

17. A data transmitting/receiving system according to claim 1, wherein said data receiving means places at least one end of said coil in a high-impedance condition when receiving data.

18. A data transmitting/receiving system of an electronic watch according to claim 2, wherein a data receiving operation of said data receiving means is intermittently enabled during a time duration in which predetermined data is transmitted from said data transmitting unit, and further wherein the receiving time period thereof is shorter than the interval for reception.

19. A data transmitting/receiving system of an electronic watch according to claim 2, wherein the duration of time in which data is received within a given said interval is shorter than the duration of time between said intervals.

20. A data transmitting/receiving system of an electronic watch according to claim 2, wherein a data signal that is generated from said data transmitting unit amplitude modulates a magnetic signal.

21. A data transmitting/receiving system of an electronic watch according to claim 20, wherein at a first receiving timing, said data receiving means performs a receiving operation at both a first pre-established phase position of said alternating current magnetic signal and a second pre-established phase position of said alternating current magnetic signal.

22. A data transmitting/receiving system of an electronic watch according to claim 21, wherein said first phase position is in the range from 0 degrees to 180 degrees, and further where said second phase position is in the range from 180 degrees to 360 degrees.

23. A data transmitting/receiving system of an electronic watch according to claim 20, wherein the data transmitting frequency of the data signal that is generated by said data transmitting unit is the same as the frequency of said magnetic signal.

24. A data transmitting/receiving system of an electronic watch according to claim 21, wherein a case in which data reception is verified at one of said phase positions at a first receiving timing, data receiving is caused to occur at said phase positions at a second and subsequent receiving timings, and data receiving is not performed at the other of said phase positions thereafter.

25. A data transmitting/receiving system of an electronic watch according to claim 24, wherein when transmitted data from said data transmitting unit is detected by said data receiving means at a phase of 90 degrees of said alternating magnetic field, a detection operation is performed at only a phase of 90 degrees thereafter for subsequent detection timings, and wherein when transmitted data from said data transmitting unit is detected by said data receiving means at a phase of 270 degrees of said alternating magnetic field, a detection operation is performed at only a phase of 270 degrees thereafter for subsequent detection timings.

26. A data transmitting/receiving system of an electronic watch according to claim 21, wherein said data receiving means performs a receiving operation at a first receiving timing at the timing when the phase of said alternating current magnetic field is 90 degrees and when the phase of said alternating current magnetic field 270 degrees.

27. A data transmitting/receiving system of an electronic watch according to claim 2, wherein the data signal that is generated from said data transmitting unit phase modulates a magnetic signal.

28. A data transmitting/receiving system of an electronic watch according to claim 2, wherein the frequency of data transmission that is performed intermittently in the data transmitting unit is 1/N times 32768 Hz, where N is an integer.

29. A data transmitting/receiving system of an electronic watch according to claim 2, wherein said timing signal is output intermittently.

30. A data transmitting/receiving system for an electronic watch according to claim 3, wherein said transmitting coil and said receiving coil are toroidal in shape and have centers that are disposed on one and the same axis.

31. A data transmitting/receiving system for an electronic watch according to claim 3, wherein the distance at which said transmitting unit can receive said timing signal is shorter than the distance at which said data receiving means can receive said transmitted data.

32. A data transmitting/receiving system for an electronic watch according to claim 3 which, wherein when said receiving means receives said timing signal that is intermittently generated at least two times, starts a data transmitting operation.

33. A data transmitting/receiving system for an electronic watch according to claim 3, wherein the signal level of the data signal that is generated by said data generation means is adjusted in accordance with the strength of the signal that is received by said timing signal receiving means.

34. A data transmitting/receiving system for an electronic watch according to claim 3, wherein said transmitting coil has a reactance that is smaller than the reactance of said receiving coil.

* * * * *